US009555303B1

(12) United States Patent
Novosel, Sr.

(10) Patent No.: US 9,555,303 B1
(45) Date of Patent: Jan. 31, 2017

(54) GOLF SWING LAG TRAINING SYSTEM

(71) Applicant: John Michael Novosel, Sr., Leawood, KS (US)

(72) Inventor: John Michael Novosel, Sr., Leawood, KS (US)

( * ) Notice: Subject to any disclaimer, the term of this patent is extended or adjusted under 35 U.S.C. 154(b) by 0 days.

(21) Appl. No.: 14/999,607

(22) Filed: Jun. 3, 2016

(51) Int. Cl.
*A63B 69/36* (2006.01)

(52) U.S. Cl.
CPC .... *A63B 69/3608* (2013.01); *A63B 2208/0204* (2013.01)

(58) Field of Classification Search
USPC ..... 473/212–214, 226, 227, 266, 276, 409
See application file for complete search history.

(56) References Cited

U.S. PATENT DOCUMENTS 5,002,275 A 3/1991 Beutler
5,184,825 A 2/1993 Ruth
5,711,718 A * 1/1998 Mueller ..... A63B 69/3638 473/234
5,851,156 A * 12/1998 Schwark, Jr. ..... A63B 69/3632 473/201
6,719,639 B2 * 4/2004 Novosel, Sr. ..... A63B 69/3608 434/252
6,955,910 B2 * 10/2005 Manosroi ..... C12N 9/6424 435/252.33
7,115,043 B2 10/2006 Leadbetter
7,618,328 B2 11/2009 Davenport
2002/0094879 A1 * 7/2002 Dawson ..... A63B 15/00 473/219

* cited by examiner

*Primary Examiner* — Nini Legesse

(57) ABSTRACT

This application provides for a new, synergistic combination of components for training an element of the golf swing normally referred to as lag. This new combination consists of a basic lag swing trainer which enables the golfer to attach additional multiple training tools or regulation golf clubs that can be interchangeably used at the same time. The additional combinations of tools that can be attached are unlimited, thereby letting golfers work on more than one of the various aspects of the swing all at the same time, for example, training the golfer in the proper sensations of the backswing technique, the swing plane, and the release of the golf club thru the hitting area. The Golf Swing Lag Training System provides any golfer with all of the kinesthetic and visual feedback that is essential to learning how to lag the golf club like a tour pro.

21 Claims, 12 Drawing Sheets

48
60R
52R
74
50R
66R 64R
70R
66L
68R 54R
64L
42
72
68L
82R
62R
70L 82L
62L

Fig.5
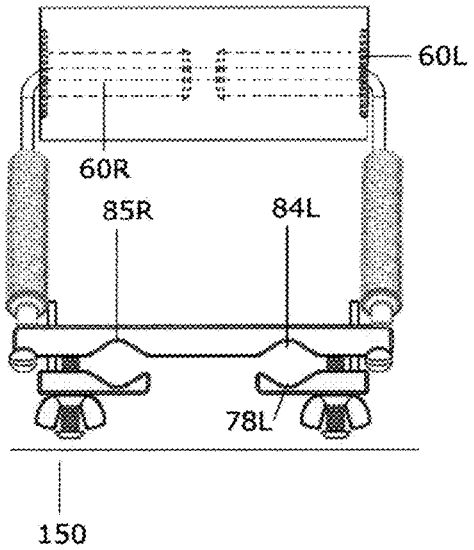
Fig.5A
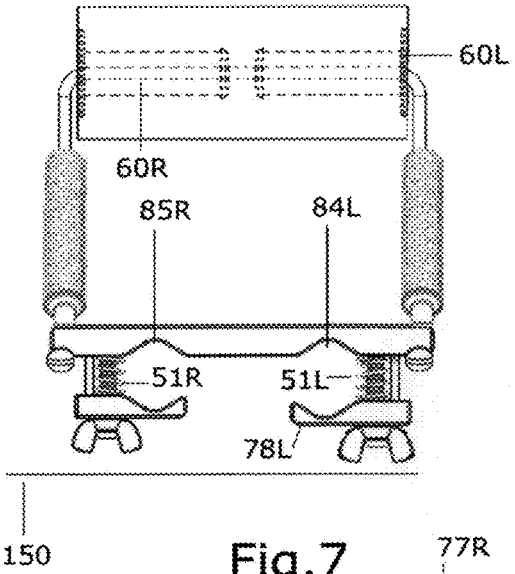
Fig.7
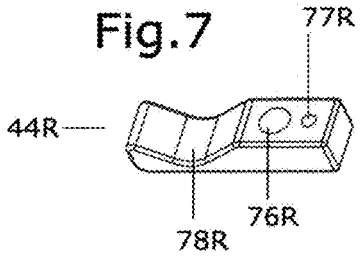
Fig.6
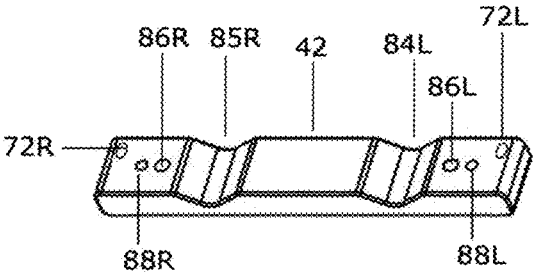
Fig.7A
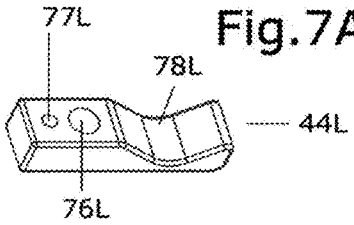
Fig.8
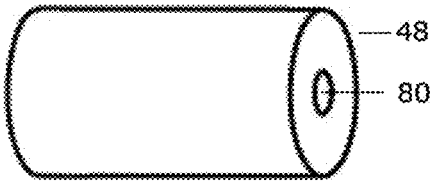
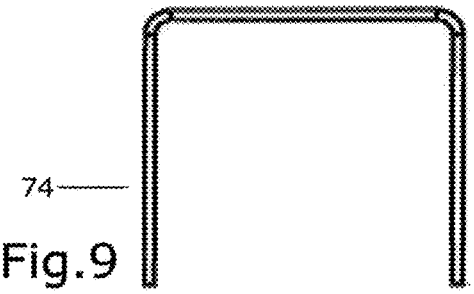
Fig.9

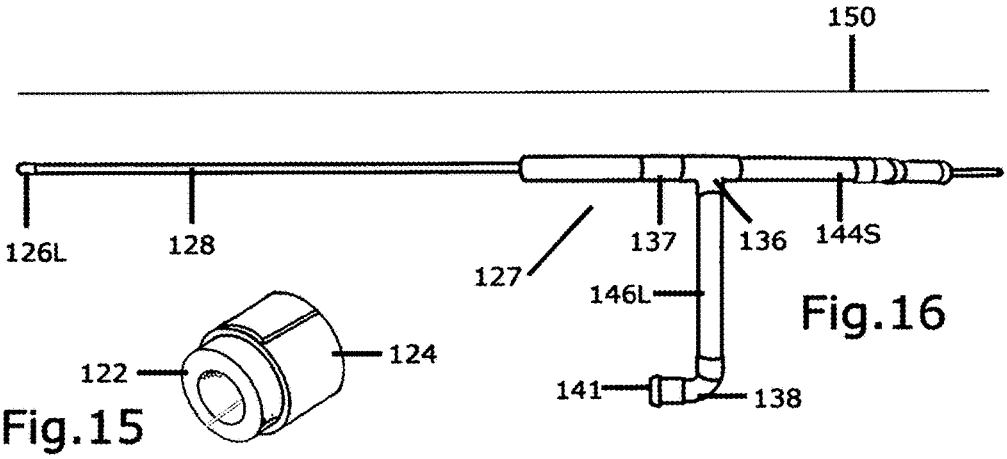
Fig.16
Fig.15
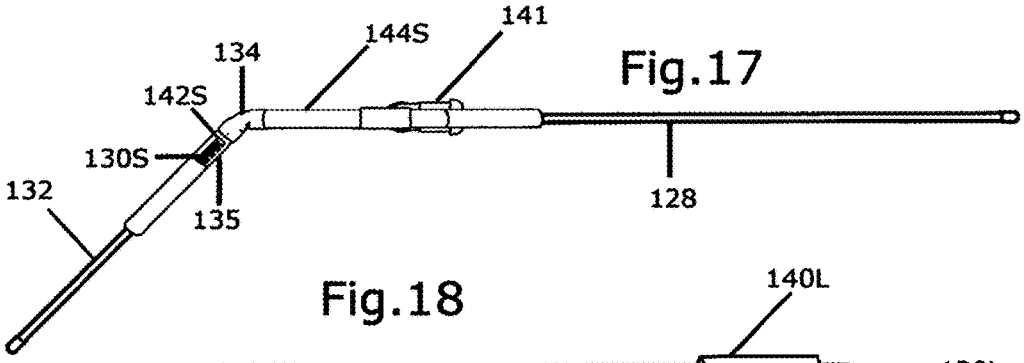
Fig.17
Fig.18
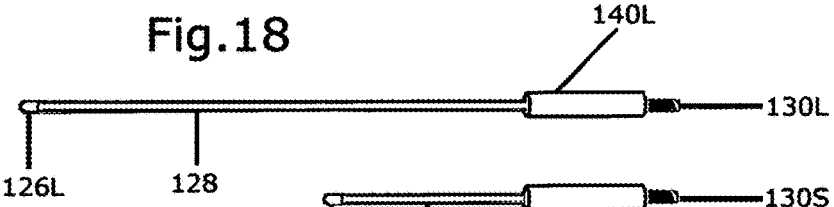
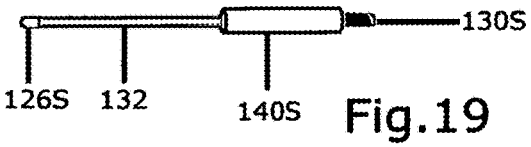
Fig.19
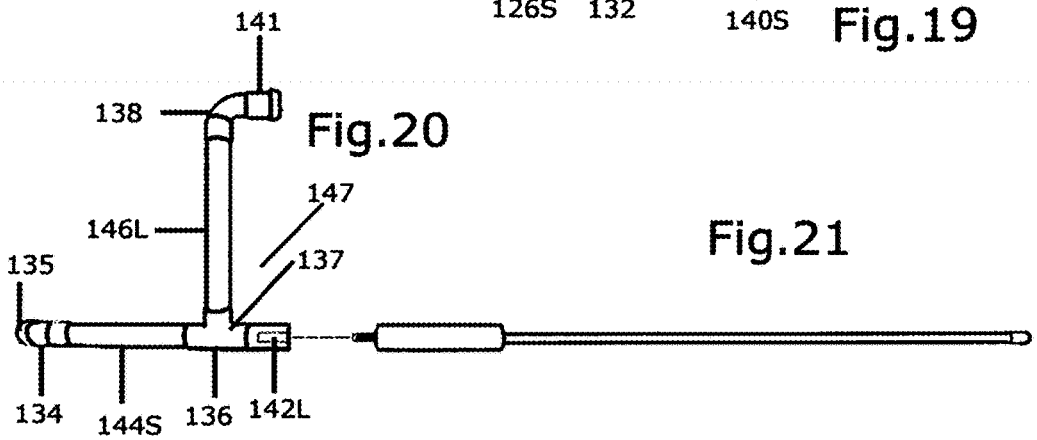
Fig.20
Fig.21

Fig. 40
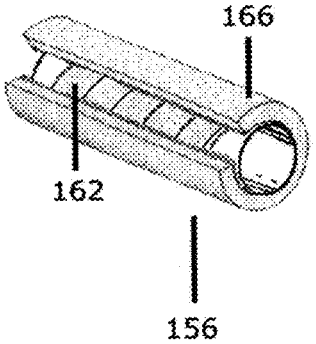
Fig. 41
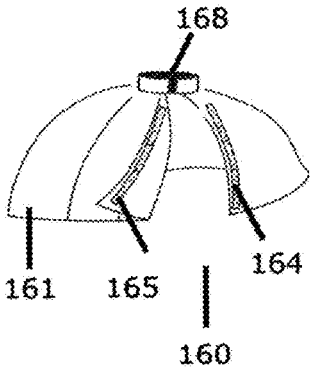
Fig. 42
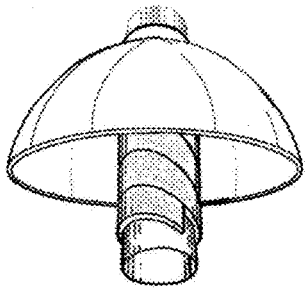
Fig. 43
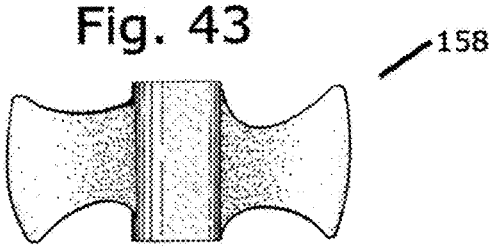
Fig. 44
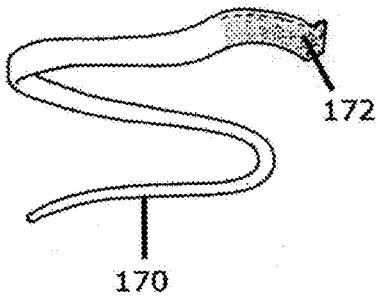
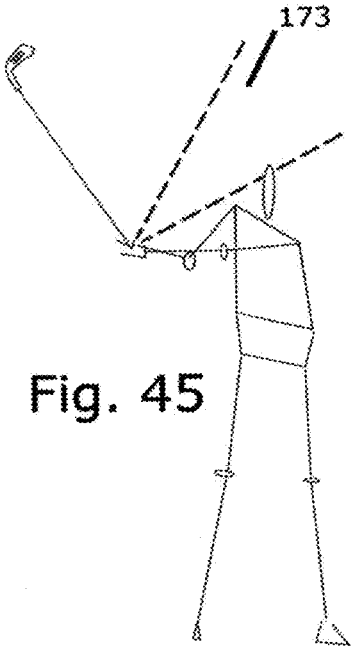
Fig. 45
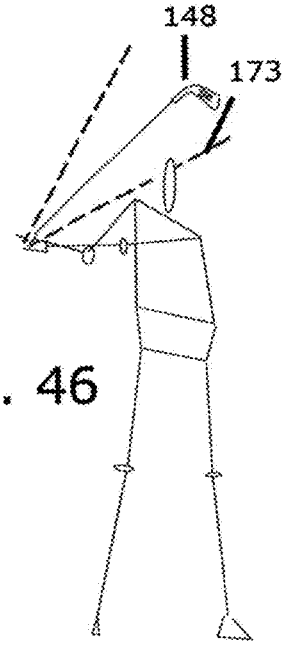
Fig. 46

Fig. 51
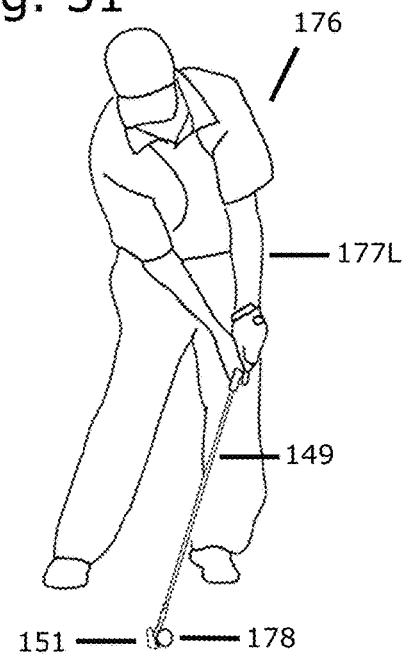
Fig. 52
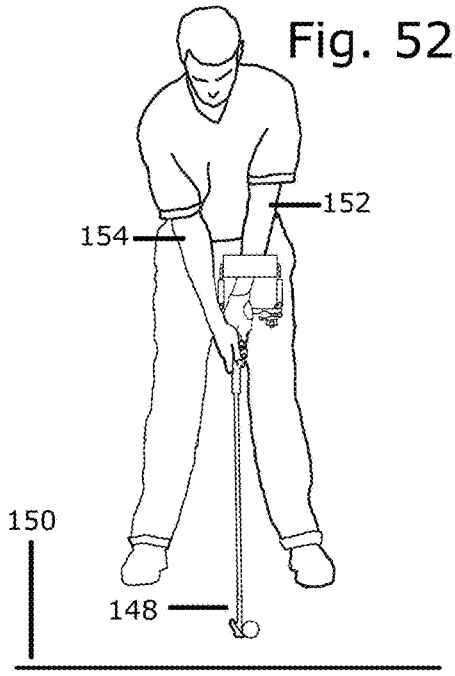
Fig. 53
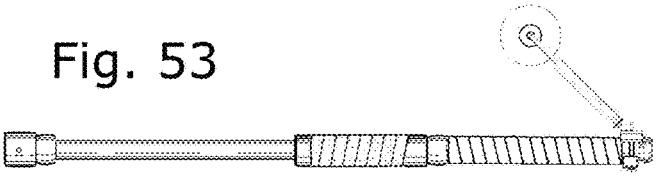
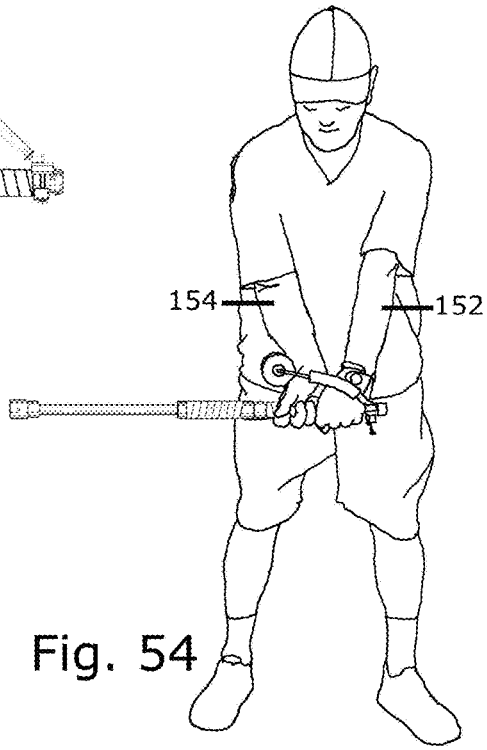
Fig. 54
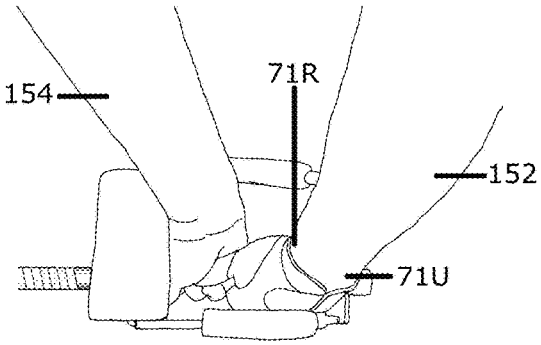
Fig. 55

Fig. 56
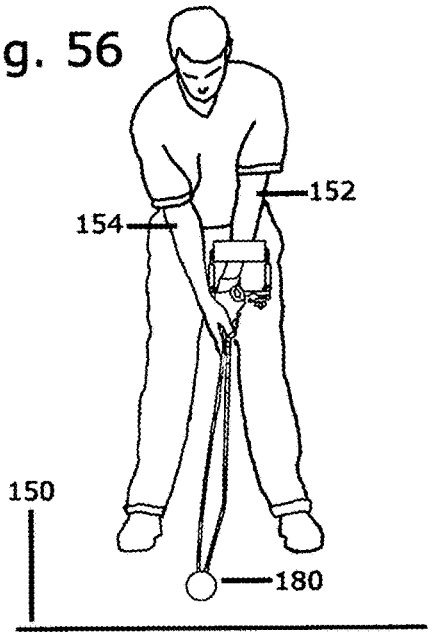
Fig. 57
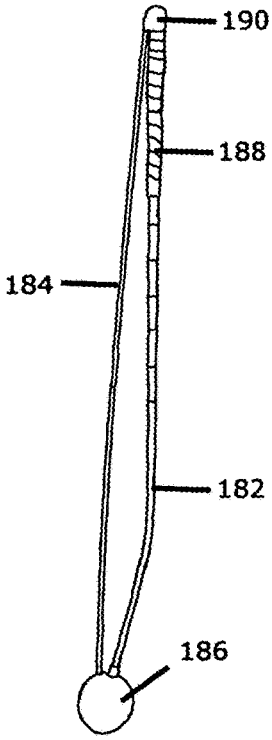
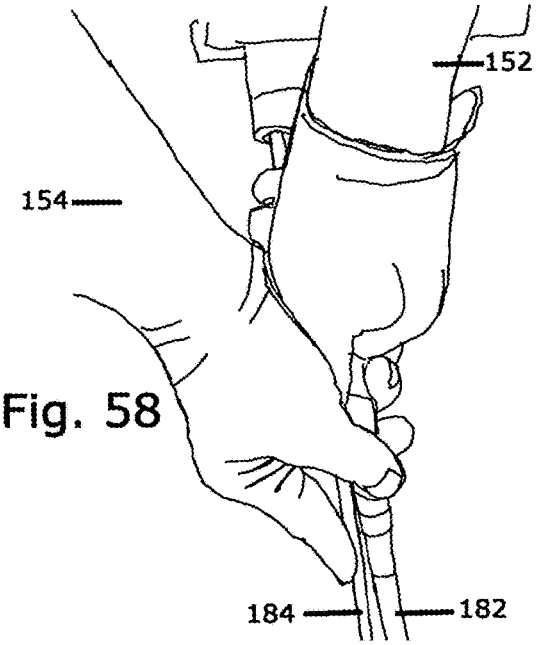
Fig. 58
Fig. 59
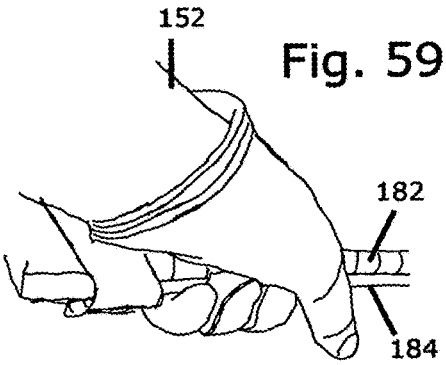

GOLF SWING LAG TRAINING SYSTEM

CROSS-REFERENCE TO RELATED APPLICATIONS

This application claims the benefit of provisional patent application Ser. No. 62/185,682, filed Jun. 28, 2015 by the present inventor, which is incorporated by reference.

BACKGROUND

Prior Art of the Invention

The following is a tabulation of some prior art that presently appears relevant:

| U. S. Patents | | |
|---|---|---|
| Pat. No. | Issue Date | Patentee |
| 7,115,043 | 2006 Oct. 3 | Leadbetter |
| 7,618,328 | 2009 Nov. 17 | Davenport |
| 5,184,825 | 1993 Feb. 9 | Ruth |
| 5,002,275 | 1991 Mar. 26 | Beutler |
| 6,719,639 | 2003 Jan. 16 | Novosel |

The foregoing patents reflect the current state of the art of which the present inventor is aware. Reference to these patents is intended to aid in discharging Applicant's acknowledged duty of candor in disclosing information that may be relevant to the examination of claims to the present invention. However, it is respectfully submitted that none of the above indicated patents disclose, teach, suggest, show, or otherwise render obvious, either singly or when considered in combination, the invention described and claimed herein.

In no prior art that I know of, has this unlimited combination of elements ever been disclosed. This invention makes it possible to attach either permanent, and/or removable, and unlimited combinations of elements by a clamping means to a basic golf trainer for the purposes of providing both the correct technique that teaches the feel of how to lag the golf club like a tour pro as well as providing a way to increase distance on every club in a golfer's bag.

BACKGROUND

This invention relates to a new combination of components for giving unmistakable positive audio, visual and kinesthetic feedback to the user for training the movements of the body to properly execute a motion in the golf swing called lag. And, in particular, to a new combination of components and a method which includes a basic swing lag trainer to which the golfer can attach multiple training tools at the same time. For the first time in the history of golf instruction, a golfer can now combine and use multiple unlimited training tools together in order to learn how to develop the lag of a tour pro. This synergistic combination of elements provides a level of instruction and instant results that has been unattainable with any previous training aid by itself.

The golf swing is a most complicated movement that is best accomplished by the interaction of the alternating contraction and relaxation of opposing muscle groups. Because this movement occurs in less than two seconds and must be coordinated to the millisecond, it cannot be controlled by conscious thought. It must be trained through the subconscious mind. Thus while in training, it is desirable that the golfer have audio, visual and kinetic feedback of how the club is swung in a correct golfing stroke, so that they can keep mental interference to a minimum.

Once the club is cocked in the backswing, the most common mechanical fault among golfers is the premature releasing of the ninety-degree angle between the radial surface of the leading arm and the club. Professional golfers are said to retain this power angle through their swings longer than less accomplished amateur golfers and therefore, consistently obtain more accuracy and distance in their golf shots. Basically tour pros develop lag in their swings and amateur golfers do the opposite. The opposite of lag, the most common fault of recreational golfers, is called by many names, namely releasing early, flipping, clubhead throw-away, chicken winging, scooping, etc. 'Coming over the top and casting' the golf club is one of the most common descriptions given to this amateur affliction. Generally speaking, unless you are a Tour Pro or low single digit handicap golfer, you're 'coming over the top and casting' the golf club. Obviously, human beings as a rule, make the wrong moves when first presented with the problem of hitting a golf ball far and straight. Human being's are evidently pre-programmed by their DNA to make the 'coming over the top and casting' move. That would explain why seventy-eight percent of all golfers can't break ninety. The chief culprit in a golfer's poor scoring efforts resides mostly in the upper right quadrant of the body for a right-handed golfer. They bring this area of the body into play at the wrong time in the swing. I've long been fascinated with the three-dimensional aspects of the golf swing, such as the ninety degree and forty-five degree angles created as a golfer moves the club thru a full golf swing, things such as the clubhead rotating clockwise and counter-clockwise as it moves through the various positions of the swing. Unfortunately the straight shaft of a golf club is one-dimensional and does not give a golfer enough three-dimensional feedback to learn how the club should be positioned in time and space and the body sequencing needed to create the lag of a tour pro.

We have found that the holy grail of the mechanics of the golf swing is creating and sustaining lag and then releasing that lag at the exact millisecond which ensures solid contact with and compression of the golf ball. Lag in the golf swing is usually thought of as 'holding the ninety degree angle' formed by the leading arm and the club shaft. Lag allows you to create centrifugal force, which stores power until it is released at impact creating what every golfer desires, namely shots that fly long and straight. Lag creates the forward leaning shaft at impact, which is the popular term now for what happens in a tour pro's swing. Actually this is just one of the manifestations or effects that happen when you create lag in your swing.

We've all noticed that the tour pro's and their swings vary in setup, grip, body style—just about everything imaginable. But, the one thing they all do is create lag. To create lag, they all make the same motion from the "delivery zone" thru impact. So, it makes total good sense to concentrate on learning the one mechanical motion that separates the tour pros from the amateurs, lag. Unfortunately, this lag is an elusive feeling to capture on a consistent basis. The problem we all face is that, even though we know what happens mechanically in the golf swing down to the millisecond, we don't know how that movement feels. Albert Einstein explains the problem with this quote—"The only source of knowledge is experience, everything else is just data." We have all of this information about the swing, but it is only data. It doesn't and can't give us the feeling that a tour pro experiences when they create lag in their swings. And, since, we don't know the feel of lag and haven't experienced that feeling on a consistent basis, we are unable to create it at will.

Stewart Maiden, who was the teacher of Bobby Jones, agrees with us. He said, in 1922, that 'coming over the top and casting' the golf club was the main fault of the average golfer and the main cause of every other fault in their golf swings.

Obviously, conventional golf instruction hasn't addressed this issue or we wouldn't have the cover of golf magazines proclaiming how to correct your slice every other year for at least the last fifty years. One article will tell you how you should hold the ninety degree power angle of the lead forearm and the club as you swing down to the ball, the next article will tell you that you must release that angle right away in order to hold the angle. Conflicting advice is very common in conventional golf instruction and especially so in the matter of learning lag. Because of this dichotomy, golfers have no easy roadmap to achieving the lag of the tour pros in their own swings.

We happened upon the Golf Swing Lag Training System by a serendipitous sequence of events. For the last 25 years, we have been holding golf schools in Lawrence, Kans. and around the country. In 2004, I co-authored a book named Tour Tempo. It was published by Doubleday of New York and became an international best seller, because, for the first time in the history of golf, we explained how to easily learn the tempo of a tour pro by sequencing your swing to a series of scientifically spaced tones that were based on the swings of the tour pros.

Over this course of time, I would also continue to invent training aids that I thought would help the average golfer that came to our golf schools get better. It finally dawned on me that this lagging of the club was a very difficult proposition to master, and that this mechanical motion of lagging was what I had been actually working on all these years. The challenge, then, was to invent a simple to use system that gave golfers the ability to immediately learn the lag of a tour pro, and then, to combine that with Tour Tempo and allow them to now play the best golf of their lives.

We have accomplished this with the Golf Swing Lag Training System. It works with all golfers, from tour pros thru beginners. The reason it works is explained by Percy Boomer, the author of 'On Learning Golf' (the longest continuously published golf instruction book in the history of golf). He said that you learn the golf swing by stringing together a series of sensations. So, to paraphrase Percy, you link together a series of perceptions and/or feelings to learn how to create and sustain the lag of a tour pro in the golf swing. After over fifty-two years of playing golf and over twenty-seven years of teaching golf, I have to agree with Percy Boomer, learning to lag the club like a golf pro must be done by sensation, or as its more commonly known, by feel.

We have achieved significant, immediate results in clubhead speed, which is one of the main indicators of whether a golfer has lag or not. For example, a PGA tour pro has an average driver clubhead speed of 105 mph to 115 mph. Your recreational golfer's average driver clubhead speed is around 80 to 90 mph We have sixty and seventy year old male golfers increasing their clubhead speed from an average of eighty mph with a driver to eighty-eight mph in less than five minutes of use of the Golf Swing Lag Training System. To give you an idea of how good this is we only need to peruse a 2007 study by the Department of Exercise and Sport Science, University of San Francisco, San Francisco, Calif. as reported in the Journal of Strength and Conditioning Research. They did a study to see how much more clubhead speed could be developed by older male golfers if they embarked on an 8-week progressive functional training program.

After putting in thirty-six hours of progressive functional training, which consisted of three 90 minute sessions a week for eight weeks, the golfers increased their clubhead speeds from 79.1 to 83.0 miles per hour. The authors of the study were very happy with a four mph increase with eight weeks of working out, when we were able to double that increase in five minutes. One of our test subjects, a sixty three year old male, increased his driver clubhead speed from 88 mph to over 105 mph in less than a month. Another test subject, a sixty year old lady golfer, increased her clubhead speed from 80 mph to 96 mph in less than a day. So we can see that by using the Golf Swing Lag Training System, golfer's have experienced new and unexpected results manifested by immediate and substantial increases in clubhead speed and lag.

The Golf Swing Lag Training System consists of five main components. The first is a basic lag trainer that through a clamping means can be interchangeably attached to the four other accessories, although it is not limited to the four, as we will explain. The basic lag trainer gives the golfer the sensation of how the wrists and forearms are used in the swing. The second component of the Golf Swing Lag Training System is a three-dimensional trainer that gives positive and negative feedback to the golfer as the swinging movement is made from start to finish. The third is an air resistance device that provides the correct feel of how the body is connectedly turned and rotated in the swing. The fourth is a shaft that includes a sliding mechanism that is best when only used with one arm at a time, although it could be used with both arms simultaneously. The sliding mechanism is constructed so that multiple and unique types of resistance can be attached to it. It gives the golfer the sensation of the correct release of the club through impact. The fifth component is a device that trains the golfer through kinesthetic feel how to engage the correct muscles at address and also how to use these muscles to start swinging the club into the backswing.

Even though we have found that this combination of devices is the best, it should be noted that regulation golf clubs and unlimited combinations of other training aids could also be mounted onto the basic lag trainer in order to learn the feel of a correct swing that exhibits the lag of a tour pro.

We have found that when any of these components or even other swing trainers are used only by themselves the results can be immediate, but with continued use of the individual trainer, these initial results will not endure. The golfer will only develop another incorrect movement in their swing, thereby losing the initial benefit that they experienced with that individual swing trainer. We have also found that for the majority of golfers, that the correct movements in the golf swing must be continually reinforced.

That's why the Golf Swing Lag Training System when joined together in the various combinations with the basic lag trainer obtains results that are quite immediate and spectacular and with continued use, they will endure for as long as the golfer plays the game. The students experience feelings and positions that their bodies have never gotten into, enabling them to dramatically increase their clubhead speed and impact alignments through emulating the lag of a tour pro. The point here is that you cannot repeat something that you've never been able to feel.

It's this new combination that provides the correct feelings of lag that are not available when the components are used separately.

A well known golf instructor, Manuel de la Torre, once said that it was important not to give a student something to work on that if they overdid it, it would become the opposite fault, i.e. correcting a slice and thereby turning that fault into a pull hook. With the Golf Swing Lag Training System, there is no problem with repeating the drills over and over, because the student is performing in real time the correct body movements and getting the instant feedback that helps them learn to lag the club like a tour pro. This provides the golfer with feedback on the correct holistic movement of the body in relation to the golf club throughout the entire stroke in an incrementally adjustable manner.

Another advantage that this device provides is that it helps a golfer co-ordinate the swinging of the arms and hands with the turning of the body. Most golfers don't know how to do this correctly. Any amateur golfer will tell you that it is very difficult to consistently replicate the coordination of the correct timing of all the body parts used in the golf swing. Many devices have been invented to alert the golfer when they are prematurely releasing the club with the incorrect movement. However, the Golf Swing Lag Training System is the only one that teaches the golfer the exact movements that they should be performing with their hand and wrists as they are coordinated with the turning of the body. Once the feel of lag is accomplished and trained, then ball contact is more consistent with every stroke in golf, from chipping and pitching, to the full swing. The Golf Swing Lag Training System provides immediate results in distance and accuracy of shots and can be used to rekindle the feeling of the correct swing even after a winter away from golf practice.

It should also be apparent that this could help any game where a participant is involved with an implement used to strike a ball. It is also apparent that various lengths and weights should be available to accommodate the difference in the bodies of men, women and children golfers.

SUMMARY

An object of this invention is to provide golfers a training aid that lets them work on all of the multiple aspects of learning lag in the golf swing at the same time. The visual, kinetic and auditory feedback that the Golf Swing Lag Training System provides enables them to quit 'coming over the top and casting' the golf club and lets them easily learn the lag of a tour pro. Another object of this invention is to provide golfers a training system that gives them immediate results in their ball striking ability. An additional object of this invention is to provide a system whereby a golfer can learn to swing with the lag of a tour pro inside their own homes, without having access to a driving range. An additional object is to provide a portable system that is easily transported from the golfer's home to the golf course. The accompanying drawings, which are incorporated in and constitute a part of this specification, illustrate one embodiment of this invention and, together with the description, serve to explain the principles of the invention. An iron club is used for some of the illustrations, but any club in the golfer's set could be used.

BRIEF DESCRIPTION OF THE DRAWINGS

FIG. 5 is a frontal view of the basic lag trainer shown in FIG. 52 that shows the interior of the large foam piece and how it is attached to the horseshoe rod.

FIG. 5A is a frontal view of an alternative embodiment of the basic lag trainer shown in FIG. 52 that shows an addition of the spacing compression springs to the base.

FIG. 6 is a perspective view of the bottom of the base.

FIG. 7 is a perspective view of the right side attachment clamp.

FIG. 7A is a perspective view of the left side attachment clamp.

FIG. 8 is a view of the large foam piece.

FIG. 9 is a view of the horseshoe rod.

FIG. 15 is a view of the silencer attachment.

FIG. 16 is an overhead view of the three-dimensional attachment as shown in FIG. 25 with the long fiberglass rod pointing towards the target.

FIG. 17 is a front view of the three-dimensional attachment as shown in FIG. 25.

FIG. 18 is a view of the long fiberglass indicator staff for the three-dimensional attachment.

FIG. 19 is a view of the short fiberglass indicator staff for the three-dimensional attachment.

FIG. 20 is a view of the base of the three-dimensional attachment without the indicator staffs attached.

FIG. 21 is a view of the long fiberglass indicator staff showing how it screws into the base of the three-dimensional attachment as shown in FIG. 20.

FIG. 40 is a view showing the completed foam covering on the slider.

FIG. 41 is a view showing the parachute attachment for the slider.

FIG. 42 is a view showing the parachute attachment for the slider attached to the loop material on the slider.

FIG. 43 is a view showing the wing attachment for the slider.

FIG. 44 is a view showing the Mylar trailer for the slider.

FIG. 45 is a view showing a stick figure of an amateur golfer at lag checkpoint number one.

FIG. 46 is a view showing a stick figure of a pro golfer at lag checkpoint number one.

FIG. 51 is a view showing a pro golfer at impact.

FIG. 52 is an anterior view showing a pro golfer at address with the basic lag trainer on a regulation golf club.

FIG. 53 is a view of an alternative way to attach the basic lag trainer onto the one-armed slider swing attachment.

FIG. 54 is a view of a golfer in the same stance as in FIG. 22, only he is holding the one-armed slider swing attachment with the basic lag trainer attached as shown in FIG. 53.

FIG. 55 is a view taken from above the golfer in the same stance as FIG. 54. with the alternative way to attach the basic lag trainer shown in FIG. 54.

FIG. 56 is an anterior view showing a pro golfer at address with the basic lag trainer on the structure training club.

FIG. 57 is a view of the structure training club itself.

FIG. 58 is a partial view showing how the trail hand index finger of the golfer in FIG. 56 is pressing the fiberglass tension rod of the structure training club towards the shaft and grip.

FIG. 59 is a partial view showing how the last three fingers of the lead hand of the golfer in FIG. 56 are pressing the fiberglass tension rod of the structure training club towards the grip.

REFERENCED NUMERALS IN DRAWING

Figure 1:
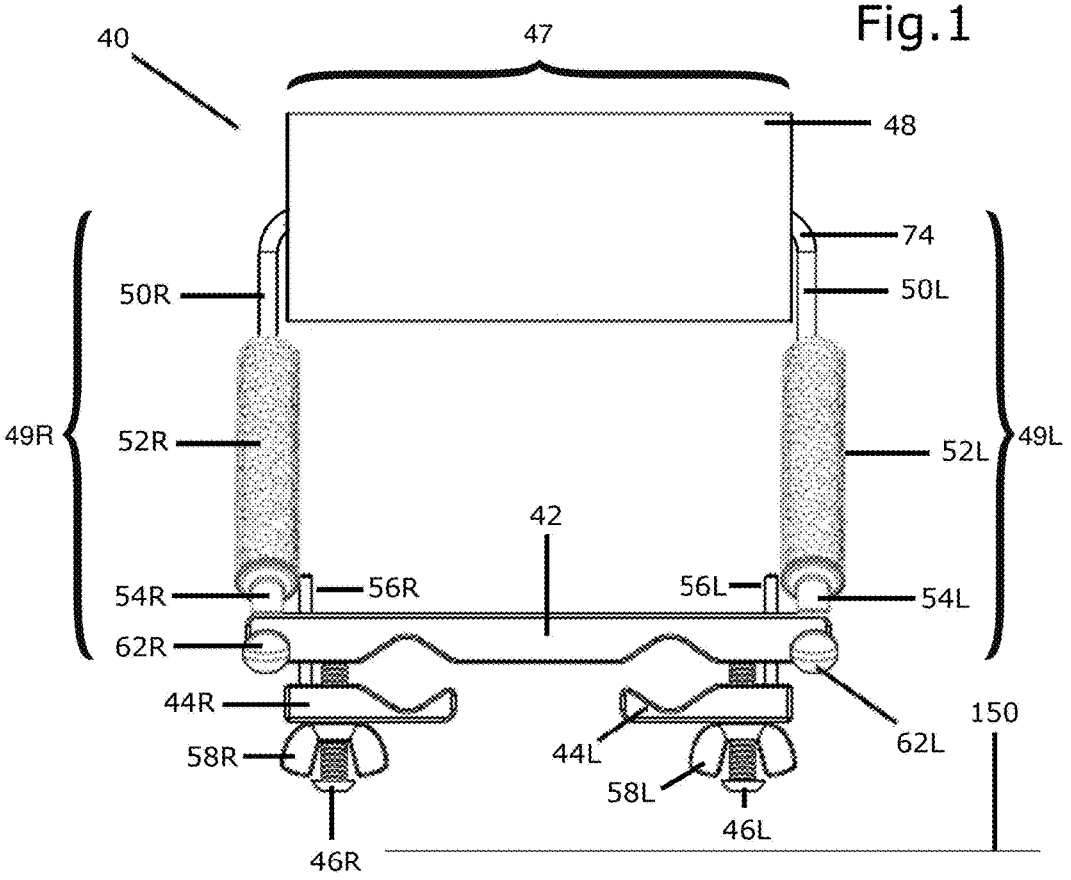
FIG. 1 is a frontal view of the basic lag trainer as it would appear if you were looking at an anterior view of the golfer's body in a normal address position as shown in FIG. 52.

40 Golf Swing Lag Training System basic lag trainer
42 Basic lag trainer base member 44R Right side basic lag trainer base attachment clamp
44L Left side basic lag trainer base attachment clamp
46R Right side basic lag trainer machine threaded screw
46L Left side basic lag trainer machine threaded screw
47 Basic lag trainer front member
48 Basic lag trainer large cylindrical foam
49R Basic lag trainer right side member
49L Basic lag trainer left side member
49H Right side member hinge
50R Right side basic lag trainer vinyl cover for the horseshoe rod
50L Left side basic lag trainer vinyl cover for the horseshoe rod
51R Right side spacing compression spring
51L Left side spacing compression spring
52R Right side basic lag trainer forearm small protective foam
52L Left side basic lag trainer forearm small protective foam
54R Right side basic lag trainer plastic cover for springs
54L Left side basic lag trainer plastic cover for springs
56R Right side basic lag trainer positioning spring pin
56L Left side basic lag trainer positioning spring pin
58R Right side basic lag trainer wing nut
58L Left side basic lag trainer wing nut
60R Right side basic lag trainer plastic insert for the large cylindrical foam
60L Left side basic lag trainer plastic insert for the large cylindrical foam
62R Right side basic lag trainer binding post
62L Left side basic lag trainer binding post
64R Right side basic lag trainer short spring
64L Left side basic lag trainer short spring
66R Right side basic lag trainer long spring
66L Left side basic lag trainer long spring
68R Right side basic lag trainer threaded stud
68L Left side basic lag trainer threaded stud
70R Right side basic lag trainer completed spring assembly
70L Left side basic lag trainer completed spring assembly
71R Radial aspect of forearm
71U Ulnar aspect of wrist
72R Right side basic lag trainer forty-five degree hole in the base for the binding post
72L Left side basic lag trainer forty-five degree hole in the base for the binding post Basic lag trainer horseshoe shaped rod frame

76R Right side basic lag trainer hole in attachment clamp for threaded screw
76L Left side basic lag trainer hole in attachment clamp for threaded screw
77R Right side basic lag trainer hole in attachment clamp for the positioning spring pin
77L Left side basic lag trainer hole in attachment clamp for the positioning spring pin
78R Right side basic lag trainer indentation in attachment clamp to accomodate the non-slip cap or a golf grip
78L Left side basic lag trainer indentation in attachment clamp to accomodate the non-slip cap or a golf grip
80 Basic lag trainer hole in the large cylindrical foam
82R Right side basic lag trainer threaded hole in binding post to receive threaded stud
82L Left side basic lag trainer threaded hole in binding post to receive threaded stud
84L Basic lag trainer left arm indentation in the base to accept the non-slip cap or a golf grip
85R Basic lag trainer right arm indentation in the base to accept the non-slip cap or a golf grip
86R Right side basic lag trainer threaded hole in base for machine threaded screw
86L Left side basic lag trainer threaded hole in base for machine threaded screw
88R Right side basic lag trainer hole in the base for positioning pin
88L Left side basic lag trainer hole in the base for positioning pin
90 Air resistance attachment for the basic lag trainer
92 Non-slip cap for air resistance attachment for the basic lag trainer
94 Grip for the air resistance attachment
96 Shaft for the air resistance attachment
98 Corrugated plastic for the air resistance attachment
100T Top washer for the air resistance attachment on grip end
100S Washer between shaft and corrugated plastic for the air resistance attachment on grip end
100B Top plastic washer for the air resistance attachment on top of plastic opposite grip end
100C Bottom washer between shaft and corrugated plastic for the air resistance attachment opposite grip end
102T Grip end screw for the air resistance attachment
102B Opposite grip end screw for the air resistance attachment
104T Grip end hex nut for the air resistance attachment
104B Opposite grip end hex nut for the air resistance attachment
105 One-armed slider swing attachment
106 Non-slip cap for the one-armed slider swing attachment
108 Shaft for the one-armed slider swing attachment
109 Slider for the one-armed slider swing attachment
110 Silencer for the one-armed slider swing attachment
112 Top hose section for the one-armed slider swing attachment
114 Bottom hose section for the one-armed slider swing attachment
116 Metal bottom stop for the one-armed slider swing attachment
118 Dowel for attaching metal bottom stop to shaft of one-armed slider swing attachment
120 Grip for the one-armed slider swing attachment
122 Soft rubber part of silencer for one-armed slider swing attachment
124 Hook and loop wrap to attach soft rubber part of silencer to the shaft of the one-armed slider swing attachment
126L Vinyl safety tip for the long fiberglass indicator rod
126S Vinyl safety tip for the short fiberglass indicator rod
127 Three-dimensional plane attachment
128 Long fiberglass indicator rod for the three-dimensional plane attachment
130L Threaded screw to attach long indicator rod to three-dimensional plane attachment
130S Threaded screw to attach short indicator rod to three-dimensional plane attachment
132 Short fiberglass indicator rod for the three-dimensional plane attachment
134 Forty-five degree bend coupling for three-dimensional plane attachment
135 Tubing connector between the forty-five degree bend coupling and the short fiberglass indicator rod
136 T shaped coupling for the three-dimensional plane attachment
137 Tubing connector between the T shaped coupling and long fiberglass indicator rod
138 Ninety-degree bend coupling for the three-dimensional plane attachment
140L Long indicator rod tubing
140S Short indicator rod tubing
141 Non-slip cap for securing the three-dimensional plane attachment
142L Threaded hole for screwing in long indicator rod for three-dimensional plane attachment
142S Threaded hole for screwing in short indicator rod for three-dimensional plane attachment
144 Short tubing piece for the basic three-dimensional plane attachment
146 Long tubing piece for the basic three-dimensional plane attachment
147 Three-dimensional plane attachment base
148 Regulation golf club
149 Shaft of the regulation golf club
150 Target line
151 Clubhead of regulation golf club
152 Golfer's lead arm
154 Golfer's trail arm
156 Large foam accessory for the slider part of the one-armed slider swing attachment
157 Hook material for the large foam accessory slider attachment
158 Wing accessory for the slider part of the one-armed slider swing attachment
160 Parachute accessory for the slider part of the one-armed slider swing attachment
161 Material for the body of the Parachute accessory
162 Loop material covering slider
164 Hook material for the slider attachment for the parachute accessory for the slider part of the one-armed slider swing attachment
165 Loop material for the slider attachment for the parachute accessory for the slider part of the one-armed slider swing attachment
166 Foam material for slider attachment
168 Hook material collar to attach parachute
170 Mylar trailer
172 Hook material for the Mylar trailer
173 First pro lag checkpoint acceptable variation
174 Second pro lag checkpoint acceptable variation
175 Third pro lag checkpoint acceptable variation
176 Tour pro at impact
177L Golfer's lead side
177T Golfer's trail side
178 Golf ball

180 Structure training club
182 Structure training club bent shaft
184 Structure training club fiberglass tension rod
186 Structure training club training head
188 Structure training club grip
190 Structure training club grip cap

DETAILED DESCRIPTION AND BEST MODE OF IMPLEMENTATION

Reference will now be made in detail to the present embodiment of the invention, an example of which is illustrated in the accompanying drawings in which like reference characters refer to corresponding elements.

With reference to FIGS. 1-9, the Golf Swing Lag Training System basic lag trainer 40 apparatus of the present embodiment is illustrated. The apparatus is preferably used with four different attachments, an air resistance attachment 90, a three-dimensional plane attachment 127, a one-armed slider swing attachment 105, and a structure training club 180. The basic lag trainer 40, alternately could be used with any combination of regular golf clubs and/or golf training devices.

FIG. 1 shows a frontal view of one version of the basic lag trainer 40. It consists of a basic lag trainer base member 42, that I presently contemplate to have a mostly rectangular cross section 12.7 mm by 25.4 mm and be 152.4 mm long and made of polycarbonate. However it can have different cross sections, such as oval, triangular, circular, etc., and different sizes and materials, such as aluminum, etc. The outer four corners and edges of the base 42 are typically beveled or rounded to avoid snagging and personal injury. Each side of the base 42 is symmetrical, so that the Golf Swing Lag Training System can accommodate either right or left handed players and has specific configurations for swinging with either the lead arm or trail arm only. Also, when we describe how to put it together, we will only describe one side with the understanding that the actions described will pertain to assembling both the left and right sides of the basic lag trainer 40.

As illustrated in FIG. 1, the basic lag trainer 40 is comprised of a generally rectangular symmetric frame comprising a front member 47, right and left side members 49R and 49L, and base member 42. Right and left side members 49R and 49L are mirror images of one another.

Figure 2:
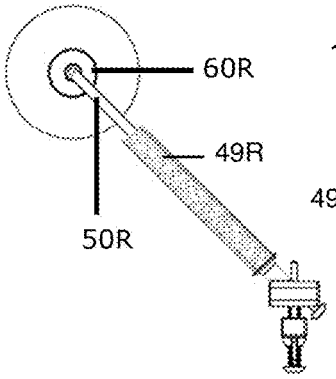
FIG. 2 is a view of the right side of the basic lag trainer as it would be positioned if you were standing on the target line behind the golfer's right shoulder in FIG. 52. The left side view is a mirror image of the right side.
Figure 2A:
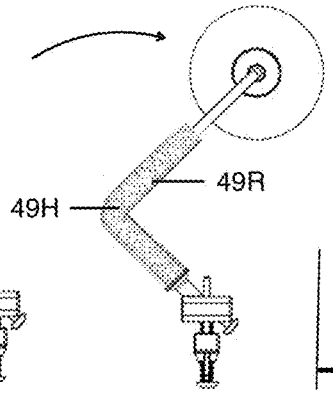
FIG. 2A is a right side view of the basic lag trainer showing how it bends forward at hinge 49R.
Figure 2B:
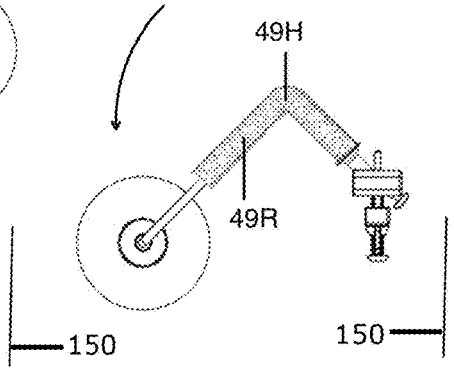
FIG. 2B is a right side view of the basic lag trainer showing how it bends backward at hinge 29R.

FIGS. 2-2B shows a right side view of the basic lag trainer 40 viewed if you were standing on the target line 150 behind the golfer's right shoulder shown in FIG. 52. FIG. 2 shows the basic lag trainer 40 in FIG. 1 in its' static position with the large cylindrical foam 48 and the right side basic lag trainer forearm small protective foam 52R angled around forty-five degrees backwards from the top of the basic lag trainer base 42.

Side members 49R and 49L (being a right side view, only right side member 49R is shown in FIG. 2) have a hinge 49H approximately midway along their length as shown in FIGS. 2A and 2B, allowing trainer 40 to be bent 90 degrees forward, as shown in FIG. 2A, and 90 degrees rearward, as shown in FIG. 2B.

FIG. 2A shows how the construction of the basic lag trainer 40 allows the small protective foam 52R to bend forward towards the target line 150 and FIG. 2B shows how it can bend backwards away from the target line 150. The basic lag trainer 40 is actually constructed so that the protective foam 52R can actually be bent about another twenty-five to thirty degrees in either direction from its' positions shown in FIG. 2A and FIG. 2B.

The base 42 has three holes on each side, one on the bottom and two that go all the way through it. The first one located on the bottom is the right side basic lag trainer threaded hole in base for machine threaded screw 86R that receives the right side basic lag trainer machine threaded screw 46R that is epoxied into it. The threaded screw 46R allows the right side basic lag trainer wing nut 58R and the right side basic lag trainer base attachment clamp 44R to securely fasten the non-slip cap 92 to the base 42. By turning the wing nut 58R clockwise, it moves the base attachment clamp 44R upwards and tightens its grip on the non-slip cap 92. Conversely, by turning the wing nut 58R counter-clockwise, it causes the base attachment clamp 44R to loosen its grip on the non-slip cap 92. A second hole that goes all the way through the base 42 is the right side basic lag trainer hole in the base for positioning pin 88R that allows the right side basic lag trainer positioning spring pin 56R to keep the base attachment clamp 44R in its correct orientation and the left side basic lag trainer hole in the base for positioning pin 88L that does the same thing for the left side. And the third hole in the base 42 is the right side basic lag trainer forty-five degree hole in the base for the binding post 72R in the base 42 for the right side basic lag trainer binding post 62R to go into. The base 42 also has two indentations, the basic lag trainer left arm indentation in the base to accept the non-slip cap or a golf grip 84L and the basic lag trainer right arm indentation in the base to accept the non-slip cap or a golf grip 85R, to help to securely fasten the non-slip cap 92 of the attachments to the basic lag trainer 40.

Attachment clamps 44R and 44L serve to removeably secure one or more golf training clubs and/or one or more golf training attachments to base member 42 at a given angle relative to trainer 40, for example, as shown in FIG. 54. Although only two attachment clamps 44 are shown in FIG. 1, trainer 40 can incorporate more than two attachment clamps 44, and other means for removeably securing golf clubs and training attachments to base member 42 can be substituted for the attachment clamps 44 shown in FIG. 1.

The attachment clamp 44R and left side basic lag trainer base attachment clamp 44L illustrated in FIGS. 7-7A can be made of the same materials as the base 42 and I presently contemplate that it has a mostly rectangular cross section 15.88 mm by 19.05 mm and be 47.63 mm long and made of polycarbonate. They also have a generally rectangular cross section and the right side basic lag trainer indentation in attachment clamp to accomodate the non-slip cap or a golf grip 78R which helps to securely fasten the non-slip cap 92 in the case of the various attachments or a grip if attaching a regulation golf club 148 to the base 42. There is also a right side basic lag trainer hole in attachment clamp for threaded screw 76R, and a left side basic lag trainer hole in attachment clamp for threaded screw 76L so that the threaded screw 46R and threaded screw 46L can pass thru each unimpeded. Another hole is provided in the attachment clamp 44R to secure the right side basic lag trainer positioning spring pin 56R. The attachment clamp 44L is a mirror image of the attachment clamp 44R and also includes the left side basic lag trainer indentation in attachment clamp to accomodate the non-slip cap or a golf grip 78L which helps to securely fasten the non-slip cap 92 in the case of the various attachments or a grip if attaching a regulation golf club 148 to the base 42. There is also a hole in the attachment clamp 44L for the left side basic lag trainer machine threaded screw 46L to pass thru unimpeded. Another hole is provided in the attachment clamp 44L to secure the left side basic lag trainer positioning spring pin 56L.

Figures 3, 4, 4A, 4B:
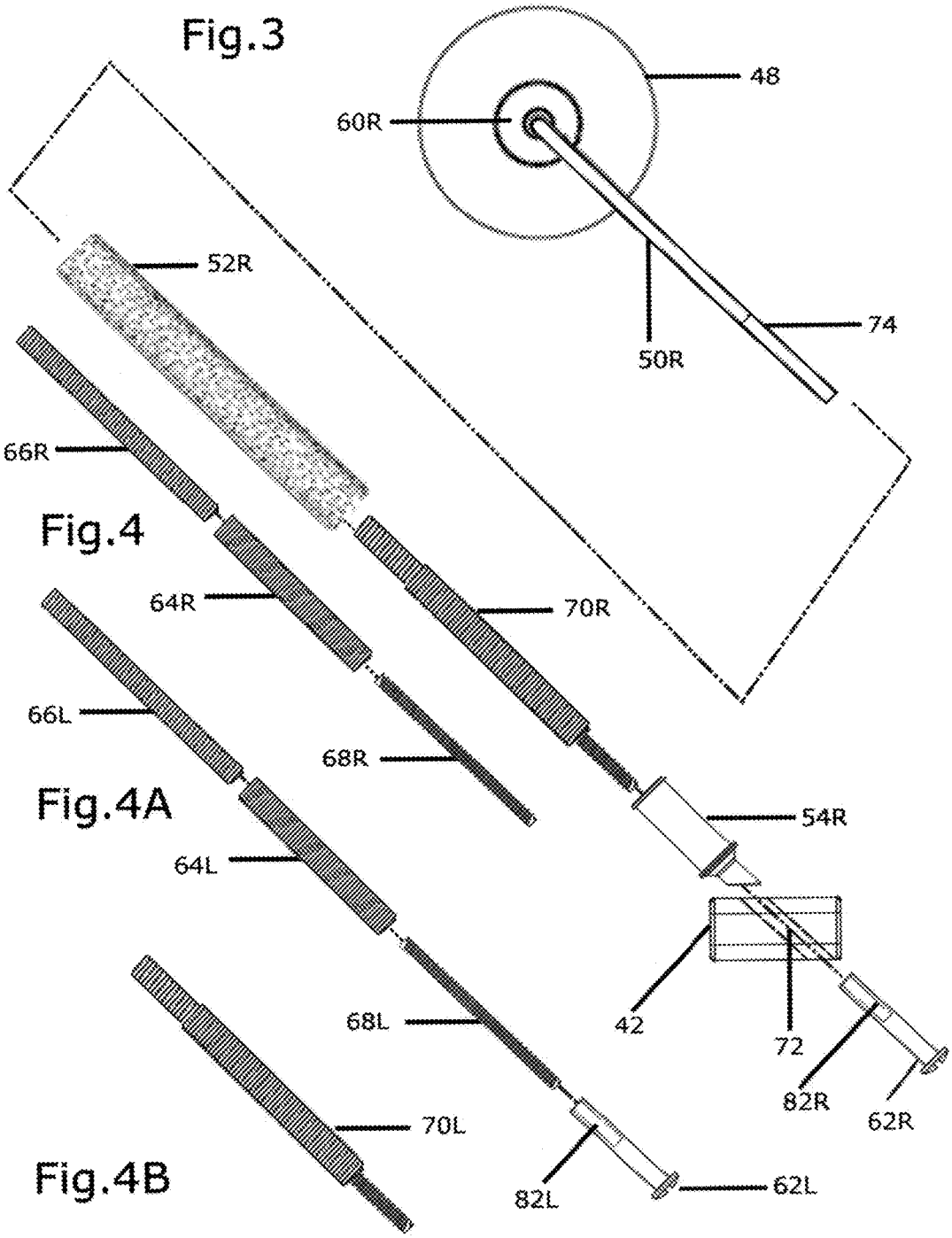
FIG. 3 is an exploded right side view taken of the basic lag trainer showing how those parts are attached to the base.
FIG. 4 is an exploded view showing how the right side spring and threaded rod of the basic lag trainer are epoxied together to form the right side completed spring assembly.
FIG. 4A is an exploded view showing how the left side springs and threaded rod of the basic lag trainer are epoxied together.
FIG. 4B is a view showing the left side completed spring assembly.

With reference to FIG. 3, this is an exploded view that illustrates how the base 42 is attached to the large cylindrical foam 48. With reference to FIG. 4, the first thing to assemble together with epoxy is the basic lag trainer completed spring assembly 70 which consists of the right side basic lag trainer short spring 64R, the right side basic lag trainer long spring 66R and the right side basic lag trainer threaded stud 68R. The short spring 64R is typically made out of a 302 stainless steel coiled spring with overall dimensions roughly 12.7 mm in diameter and 7.62 cm long. The basic lag trainer long spring 66R is typically made out of a 302 stainless steel coiled spring with overall dimensions roughly 11.43 mm in diameter and 10.16 cm long. The threaded stud 68R is typically made out of zinc plated steel with overall dimensions of 10-24 thread and about 63.5 mm long. FIGS. 2-4 show how the completed assembly is angled at about forty-five degrees from the top of the base 42. The length from the top of the large cylindrical foam 48 to the end of the threaded stud 68R should be approximately 25.4 cm to accommodate the various sized forearms of most golfers.

The next module to put together is the basic lag trainer large cylindrical foam 48 module as shown in FIG. 5. It consists of the large cylindrical foam 48, the right side basic lag trainer vinyl cover for the horseshoe rod 50R, the left side basic lag trainer vinyl cover for the horseshoe rod 50L and the right side basic lag trainer plastic insert for the large cylindrical foam 60R, the left side basic lag trainer plastic insert for the large cylindrical foam 60L, and the basic lag trainer horseshoe shaped rod 74. The large cylindrical foam 48 is typically made out of polyethylene foam, but could also be made out of just about any soft foam material, with dimensions of 6.99 cm diameter, 12.7 cm in length with a 19.05 cm longitudinal basic lag trainer hole in the large cylindrical foam 80. The vinyl cover for the horseshoe rod 50R and the vinyl cover for the horseshoe rod 50L are constructed of polyvinylchloride and fit over the ends of the basic lag trainer horseshoe shaped rod 74. The plastic insert for the large cylindrical foam 60R and plastic insert for the large cylindrical foam 60L are constructed of nylon or any hard plastic and they are inserted without any type of glue into both ends of the large cylindrical foam 48. The basic lag trainer horseshoe shaped rod 74 is constructed out of 4.76 mm diameter 304 stainless steel.

In order to get the large cylindrical foam 48 onto the basic lag trainer horseshoe shaped rod 74, it is necessary to form the rod in an L shape and then put it into a wire bending apparatus and then slide the combined large cylindrical foam 48 which has had both the plastic insert for the large cylindrical foam 60R and the plastic insert for the large cylindrical foam 60L inserted into the ends, onto the basic lag trainer horseshoe shaped rod 74 and then bend it into the horseshoe shape. Then slip the vinyl cover for the horseshoe rod 50R and the vinyl cover for the horseshoe rod 50L onto both sides of the basic lag trainer horseshoe shaped rod 74. The shape it will finally get into is illustrated in FIG. 9. Then the ends of the horseshoe shaped rod 74 should be sanded and then epoxied into the ends of the right side basic lag trainer completed spring assembly 70R and the left side basic lag trainer completed spring assembly 70L and left to dry.

Once the aforementioned modules are put together, then the rest of the assembly can start. First, the right side basic lag trainer plastic cover for springs 54R and the left side basic lag trainer plastic cover for springs 54L are inserted into the ends of the protective foam 52R and the protective foam 52L, then the opposite ends are inserted into their respective spring assemblies. Then the binding post 62R and the left side basic lag trainer binding post 62L are put thru the forty-five degree hole 72R and the left side basic lag trainer forty-five degree hole in the base for the binding post 72L. Then epoxy is applied on the end of the threaded stud 68R and the left side basic lag trainer threaded stud 68L. These are then epoxied into the right side basic lag trainer threaded hole in binding post to receive threaded stud 82R and the left side basic lag trainer threaded hole in binding post to receive threaded stud 82L.

Next, the wing nut 58R and the wing nut 58L are screwed onto the threaded screw 46R and the threaded screw 46L with the wings aligned towards the head of the machine screw 46. Then the right side basic lag trainer positioning spring pin 56R and the left side basic lag trainer positioning spring pin 56L are tapped with a hammer so that they fit into the right side basic lag trainer hole in attachment clamp for the positioning spring pin 77R and the left side basic lag trainer hole in attachment clamp for the positioning spring 77L. This assembly is then epoxied into the threaded hole 86R and threaded hole 86L so it looks just like FIG. 1. The machine screw 46 is made out of zinc coated steel and ¼—20 thread and diameter and approximately 63.50 mm long. FIG. 5A shows an alternative embodiment of the base 42 with the right side spacing compression spring 51R and the left side spacing compression spring 51L put over the threaded screw 46R and the threaded screw 46L, in order to keep the attachment clamp 44R and the attachment clamp 44L square to the base 42. It would be best to use 0.045 diameter 302 stainless steel material for the compression spring 51R and the compression spring 51L.

Figure 33:
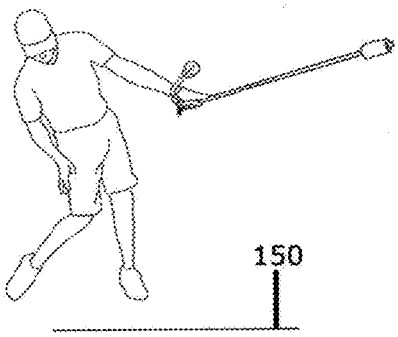
FIG. 33 is a view showing the golfer performing the lead arm only drill with the slider attachment mounted on the basic lag trainer where centrifugal force has caused the large foam piece to come off of the forearm.
Figure 34:
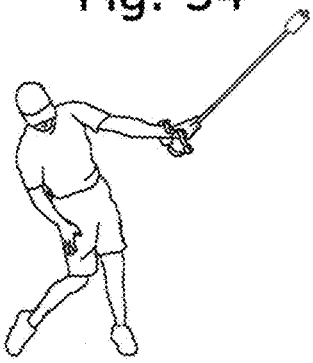
FIG. 34 is a view showing the golfer at the finish of the lead arm only drill where the large foam piece has rebounded back onto the forearm.

The basic lag trainer 40 is constructed so that the cylindrical foam 48 can be moved toward the base 42 when the golfer's left wrist becomes pronated and radial deviated. The right side basic lag trainer short spring 64R, the left side basic lag trainer short spring 64L, and the right side basic lag trainer long spring 66R and the left side basic lag trainer long spring 66L are extension springs that exert a restoring force on the basic lag trainer horseshoe shaped rod 74 when they are displaced by the movements of the golf swing. In particular, the restoring forces of centripetal and centrifugal energy that provide feedback as illustrated in FIGS. 33-34. On the forward swing, centrifugal force will cause the cylindrical foam 48 to come off the radial aspect 71R (labeled in FIG. 55 described below) of the lead forearm as shown in FIG. 33. FIG. 34 shows how the cylindrical foam 48 now snaps back onto the golfer's lead forearm, making a popping sound which provides audio sensory feedback. In another embodiment, the springs could be constructed out of torsion springs, such as those used in clothespins and such.

Figure 10:
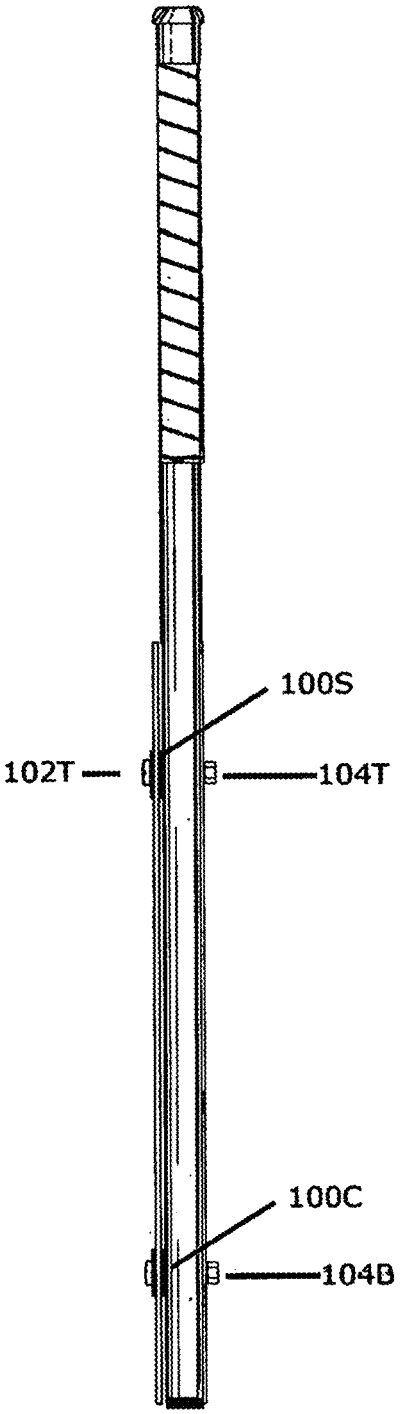
FIG. 10 is an overhead view of the air resistance attachment rotated ninety degrees counter-clockwise from FIG. 11.
Figure 11:
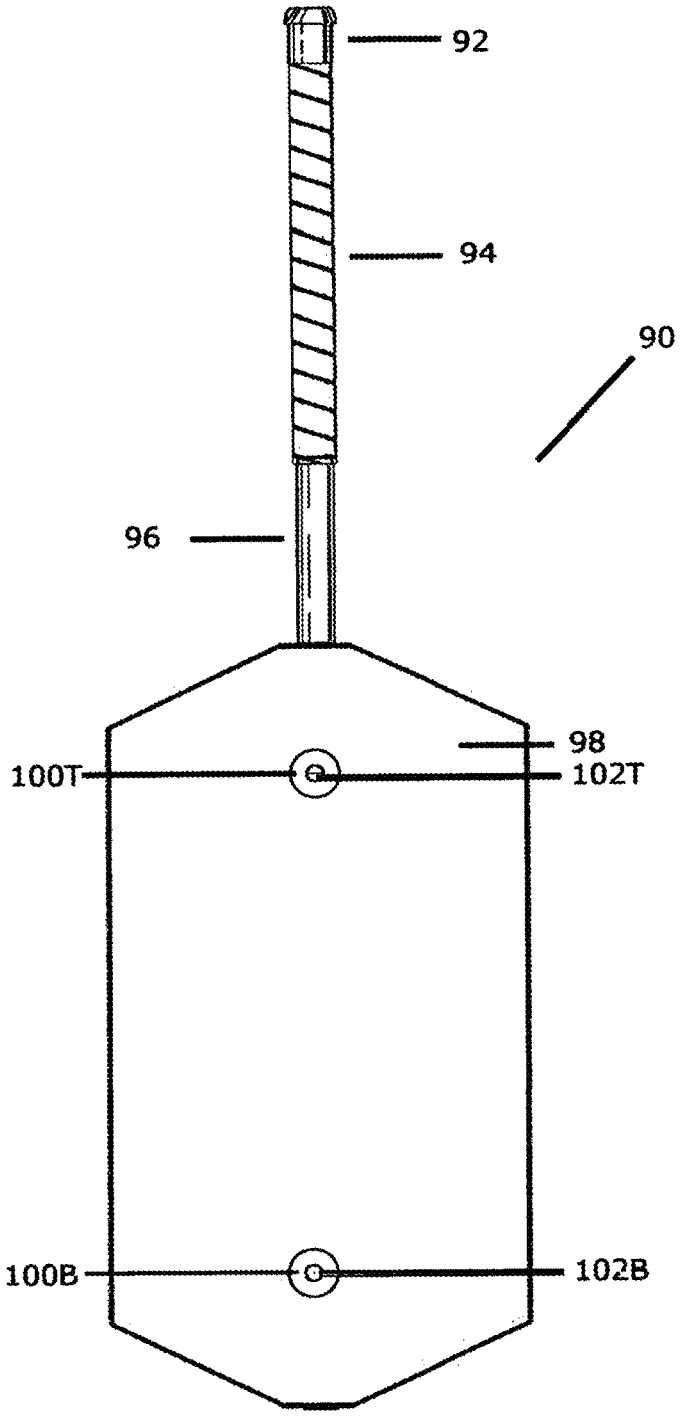
FIG. 11 is an overhead view of the air resistance attachment with its top surface parallel to the ground.

With reference to FIGS. 10-11, the Golf Swing Lag Training System air resistance attachment for the basic lag trainer 90 apparatus of the present embodiment is illustrated. It consists of a shaft for the air resistance attachment 96, preferably made out of a lightweight metal or PVC piping approximately 109.22 cm long with an outside diameter of 19.05 mm. On one end it has a non-slip cap for air resistance attachment for the basic lag trainer 92, and right below a grip for the air resistance attachment 94 preferably like the replacement grips used on tennis racquets. Attached to the shaft 96 is the corrugated plastic for the air resistance attachment 98. On the grip end it is connected by the grip end screw for the air resistance attachment 102T, the grip end hex nut for the air resistance attachment 104T, the top washer for the air resistance attachment on grip end 100T and the washer between shaft and corrugated plastic for the air resistance attachment on grip end 100S. Opposite the grip 94 end, the corrugated plastic 98 is connected to the shaft 96 by the opposite grip end screw for the air resistance attachment 102B, the opposite grip end hex nut for the air resistance attachment 104B, the top plastic washer for the air resistance attachment on top of plastic opposite grip end 100B and the bottom washer between shaft and corrugated plastic for the air resistance attachment opposite grip end 100C.

The two screws 102T and 102B are made out of zinc plated steel and their dimensions are ¼-20 Thread, and 38.1 mm in length. The corrugated plastic 98 is around 3.175 mm thick with a length of about 736.6 mm and a width of about 431.8 mm. It is shown with a diagonal pattern, but could be more rounded or more angular. FIG. 11 shows how the shaft 96 is attached on the bottom side of the corrugated plastic 98.

Figure 12:
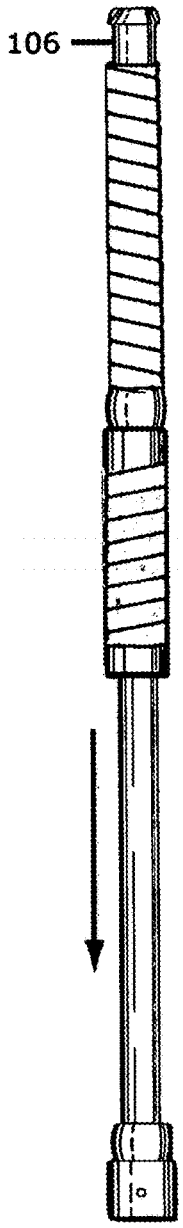
FIG. 12 is a view of the slider attachment with the sliding part near the grip.
Figure 13:
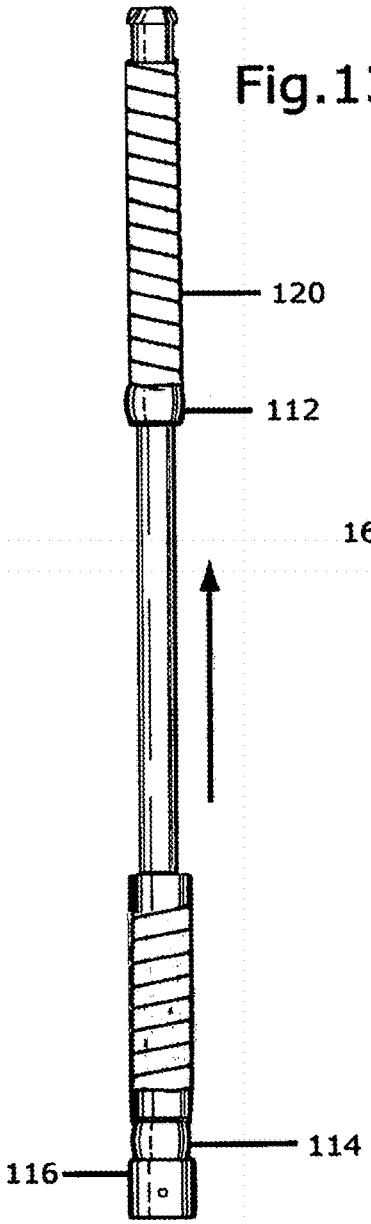
FIG. 13 is a view of the slider attachment with the sliding part at the end of the shaft.
Figure 14:
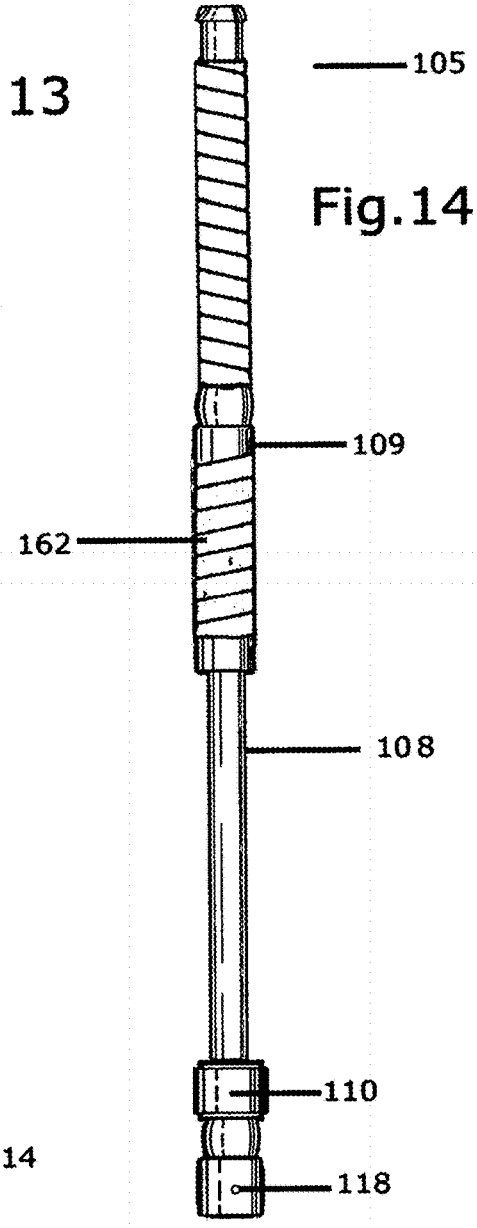
FIG. 14 is a view of the slider attachment with the silencer attached to the shaft.
Figure 38:
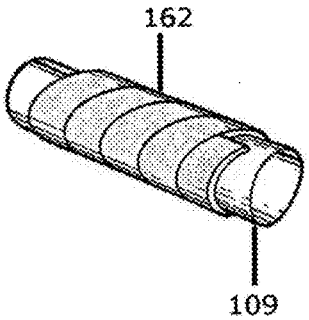
FIG. 38 is a view showing the loop material covering the slider.

With reference to FIGS. 12-14, the one-armed slider swing attachment 105 apparatus in its present embodiment is illustrated. It consists of a shaft for the one-armed slider swing attachment 108, which is around 101.6 cm long with an interior diameter of 16.10 mm and outer diameter of 19.05 mm. It has a non-slip cap for the one-armed slider swing attachment 106 on one end and a metal bottom stop for the one-armed slider swing attachment 116 on the other. The metal bottom stop for the one-armed slider swing attachment 116 is attached to the shaft 108 by a dowel for attaching metal bottom stop to shaft of one-armed slider swing 118. Underneath the cap for the one-armed slider swing attachment 106 is the grip for the one-armed slider swing attachment 120 which is preferably made out of the same material as the grip 94. Both of these will be thicker than an ordinary slip-on golf grip. The next thing on the shaft for the one-armed slider swing attachment 108 is the top hose section for the one-armed slider swing attachment 112. This would be best composed of a length of aramid reinforced hose with an interior diameter of 19.05 mm, 25.4 mm in length and outer diameter of 25.4 mm. The slider for the one-armed slider swing attachment 109 is in between the two hose sections. It moves up and down the shaft between them. The dimensions for the aluminum slider for the one-armed slider swing attachment 109 are around 10.16 cm long with an interior diameter of 19.74 mm and outer diameter of 23.55 mm. FIG. 38 also illustrates the slider 109 which is covered with a loop material covering the slider 162 so that unlimited accessories can be attached to it.

FIG. 12 shows the slider 109 closest to the grip for the one-armed slider swing attachment 120. FIG. 13 shows the slider 109 closest to the bottom hose section for the one-armed slider swing attachment 114. FIG. 14 shows the silencer for the one-armed slider swing attachment 110. The purpose of the silencer 110 is to have very little sound emanate from the result of the slider 109 colliding with the bottom hose section 114. Normally, when the golfer was practicing alone, this would be a highly desired feedback popping sound if the silencer 110 were not attached. However, if the golfer were at the range with other golfers nearby, they would not want that type of sound feedback as it might interfere with the other golfer's practice. The silencer 110 is composed of two pieces. The first is a soft rubber part of silencer for one-armed slider swing attachment 122 composed of nitrile foam about 8 mm thick and 25.4 mm wide and 80 mm long. The second is a hook and loop wrap to attach soft rubber part of silencer to the shaft of the one-armed slider swing attachment 124. It is sewn or fused to the soft rubber part 122 which is about 203 mm long which when wrapped back on itself secures the silencer 110 onto the shaft 108. FIG. 14 also shows the loop material 162 that enables multiple accessories to be attached to it.

Figure 39:
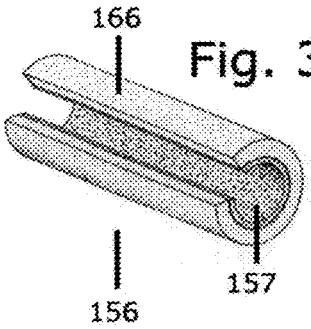
FIG. 39 is a view showing the construction for the foam attachment for the slider.

There are also four accessory add-ons for the slider 109 illustrated in FIGS. 39-44. The first is the large foam accessory for the slider part of the one-armed slider swing attachment 156 illustrated in FIGS. 39-40. FIG. 39 shows how it is constructed. It has a flexible polyethylene foam material for the foam material for slider attachment 166 on the outside bonded to the hook material for the large foam accessory slider attachment 157 on the inside. FIG. 40 shows how it is attached and mated to the loop material covering the slider 162.

FIGS. 41-42 illustrates the second accessory which is the parachute accessory for the slider part of the one-armed slider swing attachment 160. The material for the body of the parachute accessory 161 could be made of just about any type of fabric. A relatively stiff fabric would work the best, or it could be flexible if reinforced on the edges. It is attached by wrapping the hook material collar to attach parachute 168 around the loop material 162, and then closing it by combining the loop material for the slider attachment for the parachute accessory for the slider part of the one-armed slider swing attachment 165 to the hook material for the slider attachment for the parachute accessory for the slider part of the one-armed slider swing attachment 164.

FIG. 43 illustrates the third accessory which is the wing accessory for the slider part of the one-armed slider swing attachment 158, which could be constructed out of a NERF type soft foam currently used in children's toys. And the fourth accessory illustrated in FIG. 44 is a Mylar trailer 170 that is attached to the slider 109 by the hook material for the Mylar trailer 172. The hook material 172 should be fused onto the Mylar trailer 170. It can also function as a sound generator, in addition to providing resistance. It should be obvious that many different types of attachments could be secured to the slider 109 to provide resistance and/or sound feedback. Examples of this would be substituting a stretch nylon type of material that was wider and longer than the Mylar trailer 172 so as to provide more air resistance.

Figure 25:
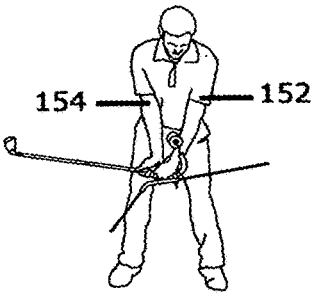
FIG. 25 is a view showing the golfer at the start of the drill with the three-dimensional attachment and a golf club mounted on the basic lag trainer.

With reference to FIG. 16, the Golf Swing Lag Training System three-dimensional plane attachment 127 apparatus of the present embodiment is illustrated in an overhead view of FIG. 25. The short fiberglass indicator rod for the three-dimensional plane attachment 132 is angled downward at an approximately forty-five degree angle. The long fiberglass indicator rod for the three-dimensional plane attachment 128 is approximately parallel to the target line 150 and pointed to the target.

FIG. 17 illustrates a belt buckle view of the three-dimensional plane attachment 127 as the golfer assumes his starting position in FIG. 25. FIG. 18 illustrates the long fiberglass indicator rod 128. It is also composed of the long indicator rod tubing 140, and the vinyl safety tip for the long fiberglass indicator rod 126L, and the threaded screw to attach long indicator rod to three-dimensional plane attachment 130L.

FIG. 19 illustrates the short fiberglass indicator rod for the three-dimensional plane attachment 132. It is also composed of the short indicator rod tubing 140S, and the vinyl safety tip for the short fiberglass indicator rod 126S, and the threaded rod to attach short indicator rod to three-dimensional plane attachment 130S. The preferred lengths of these staffs should be in a ratio of two to one. The preferred length of the long fiberglass indicator rod 128 is 35.56 cm and 17.78 cm for the length of the short fiberglass indicator rod 132.

FIG. 20 illustrates the three-dimensional plane attachment base 147 which is composed of the tubing connector between the forty-five degree bend coupling and the short fiberglass indicator rod 135 which has a threaded hole for screwing in short indicator rod for three-dimensional plane 142S, the tubing connector between the T shaped coupling and the long fiberglass indicator rod 137, both having a threaded hole for screwing in the indicator rod for the three-dimensional plane attachment 142, and a non-slip cap for securing the three-dimensional plane attachment 141, a long tubing piece for the basic three-dimensional plane attachment 146L, a short tubing piece for the basic three-dimensional plane attachment 144S, a T shaped coupling for the three-dimensional plane attachment 136T, a ninety-degree bend coupling for the three-dimensional plane attachment 138 and a forty-five degree bend coupling for the three-dimensional plane attachment 134. FIG. 21 illustrates how the long fiberglass indicator rod 128 in FIG. 18 is attached to the three-dimensional plane attachment base 147 by screwing them into the threaded hole 142L. The attachment base 147 would obviously have to be constructed in the reverse for a left-handed golfer.

Operation—FIGS. 22-37 and FIGS. 45-55

Figure 22:
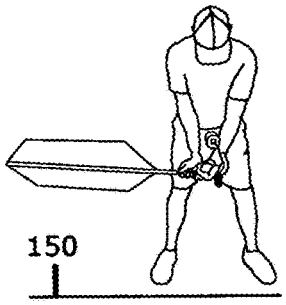
FIG. 22 is a view showing the golfer at the start of the drill with the air resistance attachment.
Figure 35:
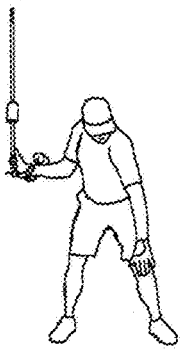
FIG. 35 is a view showing the golfer at the start of the trail arm only drill with the slider attachment mounted on the basic lag trainer.
Figure 36:
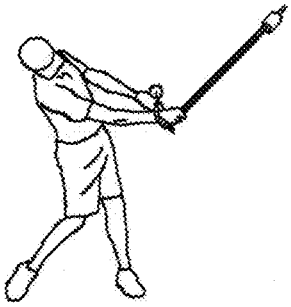
FIG. 36 is a view showing the golfer performing the trail arm only drill with the slider attachment mounted on the basic lag trainer where centrifugal force has caused the large foam piece to come off of the forearm.
Figure 37:
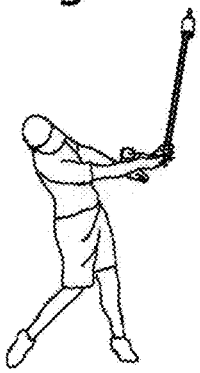
FIG. 37 is a view showing the golfer at the finish of the trail arm only drill where the large foam piece has rebounded back onto the forearm.

The first thing to do is to start out exactly as FIG. 22 illustrates. The golfer's lead arm 152 is inserted into the horseshoe rod 74 with their ulnar forearm aspect 71U touching the base 42, also referred to as the back member. The golfer's right hand grip is put on in the normal manner outside the horseshoe rod 74. The air resistance attachment 90 is attached by securing the non-slip cap 92 between the right arm indentation 85R and the indentation in the attachment clamp 78R by tightening the wing nut 58R. For a right-handed golfer, when doing the drills with both hands grasping the grip as shown in FIGS. 22-30, the accessory is attached to the right arm indentation 85R. For a right-handed golfer, when doing the individual left arm drills, the accessory is attached to the right arm indentation 85 as shown in FIGS. 31-34. For a right-handed golfer, when doing the individual right arm drills, the accessory is attached to the basic lag trainer left arm indentation in the base to accept the non-slip cap or a golf grip 84L as shown in FIGS. 35-37. And, of course, just the opposite would apply if the golfer were left-handed.

The golfer assumes a normal golf stance with the golfer's lead arm 152 about perpendicular to the ground, and the back of their lead hand facing the target line 150. This causes the shaft for the air resistance attachment 96 to be positioned parallel to the target line 150 and parallel to the ground.

The top surface closest to the target line 150 of the corrugated plastic for air resistance attachment 98 is angled upward about thirty to forty-five degrees from parallel to the ground. From here, the golfer simultaneously starts to cock their wrists which causes the large cylindrical foam 48 to move towards the golfer's lead wrist, and also turns their body to the position shown in FIG. 23 with the golfer's lead arm 152 parallel to the ground and at this point, the shaft for the air resistance attachment 96 forms a forty-five degree angle with the golfer's lead arm 152. This is the top of the backswing position for the air resistance drill.

This drill teaches the golfer how to make the correct backswing by getting them to feel the rotation of the body as they simultaneously cock their wrists, instead of just pulling the club away with their hand and arms and leaving the body at address. I've analyzed over ten thousand PGA tour pro swings for their tempo since the year 2000, and as I was doing that I noticed that sometimes when I couldn't see the clubhead as it started backwards away from the ball in the backswing, I could use the initial movement of the lead shoulder to start counting the individual frames of video that composed the tour player's backswing. The reason that I could use the lead shoulder to start the frame count is that most all tour pros start their backswings with the clubhead moving at the same time as the lead shoulder starts to rotate backward. I found that amateurs do exactly the opposite, they start their backswings by moving the hands and arms separately and pulling their lead shoulder back, instead of making the backswing a total co-ordinated movement of their lead shoulder, arms, and clubhead like the tour pros do.

Figure 23:
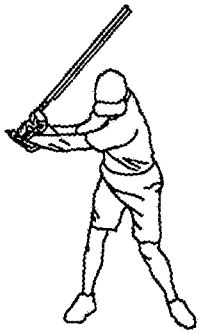
FIG. 23 is a view showing the golfer at the top of the backswing with the air resistance attachment.
Figure 24:
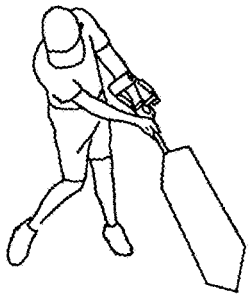
FIG. 24 is a view showing the golfer at the finish of the drill with the air resistance attachment.

So now from the position shown in FIG. 23, the golfer just rotates their body back to the position shown in FIG. 24 where the basic lag trainer large cylindrical foam 48 is angled about forty-five degrees upward. This drill teaches the golfer how to get the feel of the correct downswing by getting them to feel how the rotation of the body starts to bring the clubhead back to impact, and how lag is created as they are doing this, instead of their normal 'coming over the top and casting the golf club' motion that is exhibited in almost all amateur golfer's swings.

Practice with the three-dimensional plane attachment 127 of the present invention is illustrated by the sequence of views of FIGS. 25-30. The golfer goes thru a series of movements, making sure that the short fiberglass indicator rod for the three-dimensional plane attachment 132 and the long fiberglass indicator rod for the three-dimensional plane attachment 128 are correctly positioned as shown in the FIGS. 25-28. As to FIG. 25, again the first thing a golfer should do is to start out with their body exactly as FIG. 22 illustrates. For a right-handed golfer, the left side of their body is normally referred to as the golfer's lead side 177L, and the right side of their body is normally referred to as the golfer's trail side 177T. The three-dimensional plane attachment 127 is attached to the lag trainer 40 by connecting the non-slip cap 141 to the left arm indentation 84, and a regulation golf club 148, preferably an eight iron is attached to the right arm indentation 85. The large cylindrical foam 48, which is also referred to as the front member, is in the middle of the golfer's body and perpendicular to the target line 150 and parallel to the ground. The shaft of the regulation golf club 149 and the long fiberglass indicator rod 128 are positioned so that they are parallel to the golfer's target line 150 and almost parallel to the ground.

Figure 26:
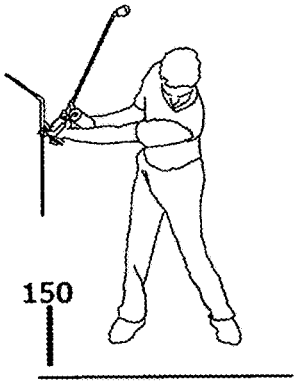
FIG. 26 is a view showing the golfer at the top of the backswing with the three-dimensional attachment on the basic lag trainer.
Figure 27:
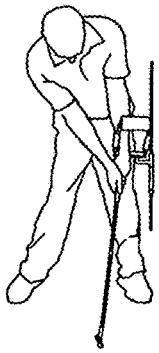
FIG. 27 is a view showing the golfer at impact with the three-dimensional attachment on the basic lag trainer.
Figure 28:
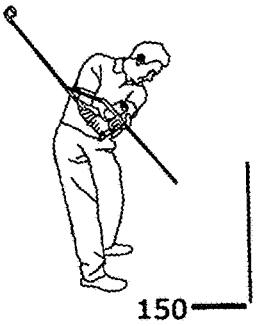
FIG. 28 is a view showing the golfer at the correct top of the backswing with the three-dimensional attachment on the basic lag trainer.

The golfer's wrists are cocked to ninety degrees and in the middle of his body. The golfer then swings backwards and to the top of the backswing for this drill as illustrated in FIG. 26. At this point, the long fiberglass indicator rod 128 points to about his target line 150 as shown in FIG. 28. In fact, the long fiberglass indicator rod 128 is always either pointing approximately to the target line 150 or parallel to it.

The short fiberglass indicator rod 132 now points forty-five degrees to the right of the target line 150 when viewed by the golfer. When he gets to impact in FIG. 27, the short fiberglass indicator rod for the three-dimensional plane attachment 132 will be slanted backwards and pointing to the outside of his toe of the front foot. The long fiberglass indicator rod 128 will be slanted forward, and should not be touching his upper body. This orientation of the rods thru impact is very important as it provides the correct parameters for the golfer to emulate in order to obtain the lag of a tour pro. If the short fiberglass indicator rod 132 and long fiberglass indicator rod 128 are not in the impact position shown in FIG. 27, then he has probably made a golf move commonly called 'coming over the top and casting the golf club.' Bobby Jones's teacher Stewart Maiden said in the 1920's that 'coming over the top and casting' the golf club was the fundamental cause of every bad shot in golf.

Figure 29:
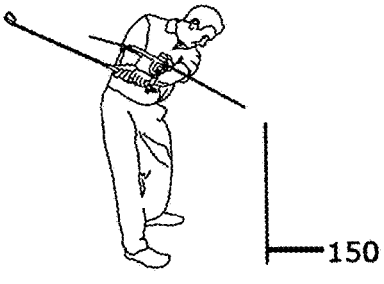
FIG. 29 is a view showing the golfer at a too horizontal incorrect angle at the top of the backswing with the three-dimensional attachment on the basic lag trainer.
Figure 30:
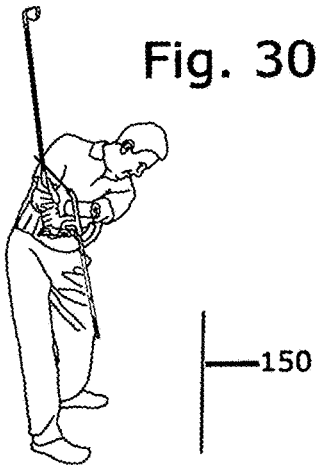
FIG. 30 is a view showing the golfer at a too vertical incorrect angle at the top of the backswing with the three-dimensional attachment on the basic lag trainer.

FIGS. 28-30 illustrate the feedback provided by the three-dimensional plane attachment 127 at the top of the backswing. The correct top of backswing position is illustrated by FIG. 28. Notice how the large cylindrical foam 48 is at an angle of around forty-five degrees to parallel, the long fiberglass indicator rod 128 is pointed towards the target line 150, the shaft of the regulation golf club 149 is also pointed towards the target line 150. Incorrect, off plane positions at the top of the backswing are illustrated in FIGS. 29-30. Notice the overly horizontal orientation of the long fiberglass indicator rod 128 is in FIG. 29 and how it does not point to the target line 150. Then, there is the overly vertical orientation of the long fiberglass indicator rod 128 which points way too inside the target line 150 in FIG. 30. This is the advantage of using the long fiberglass indicator rod 128 during training because the golfer can actually see in their peripheral vision the exact plane that their shaft of the regulation golf club 149 is on, by where it is pointing. This is feedback that would normally not be available to the golfer because the shaft of the regulation golf club 149 is normally out of their field of vision at this point in the swing.

For years when we started lessons with golfers, we would ask them to make a chipping type motion. Invariably, they will then respond with a full, actually over-swinging motion. Now with the Golf Swing Lag Training System, I can tell them to make a chipping type motion and they can start to feel exactly how and where the short fiberglass indicator rod 132 and long fiberglass indicator rod 128 should be in space at any particular time in that motion. They can see exactly how they have taken the club too far back. By letting the training rods on the device dictate their movements, the golfer learns how it feels to have the lag of a tour pro.

Figure 31:
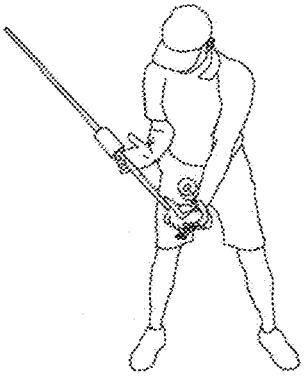
FIG. 31 is a view showing the golfer at the start of the lead arm only drill with the slider attachment mounted on the basic lag trainer.
Figure 32:
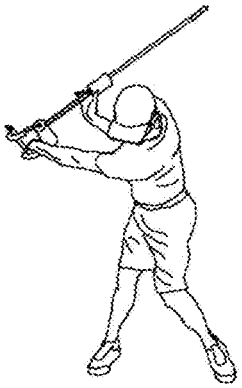
FIG. 32 is a view showing the golfer at the top of backswing with the lead arm only drill with the slider attachment mounted on the basic lag trainer.

Practice with the one-armed slider swing attachment 105 of the present invention is illustrated by the sequence of views of FIGS. 31-37. FIG. 31 illustrates the starting position for the lead arm drill. The one-armed slider swing attachment 105 is attached by securing the non-slip cap for the one-armed slider swing attachment 106 into the basic lag trainer right arm indentation in the base to accept the non-slip cap 85. The golfer's trail elbow is tucked into the golfer's trail side 177T, the golfer's lead arm 152 is straight and angled enough so that the lead hand is over the trail thigh. The large cylindrical foam 48 is angled forty-five degrees upward and the trail hand grasps the shaft for the one-armed slider swing attachment 108 between the grip for the one-armed slider swing attachment 120 and the slider for the one-armed slider swing attachment 109. From this starting position, the golfer maintains the triangle formed by their arms and shoulders as shown in FIG. 31 and then turns to the position shown in FIG. 32. Now, the golfer swings forward and lets go of the shaft 108 with their right hand when it gets back in front of their body, and then continues forward with the left hand only as illustrated in FIG. 33.

When the drill is done correctly, centrifugal force will cause the large cylindrical foam 48 to come off the lead forearm and it will be both perpendicular to the target line 150 and parallel to the ground as shown in FIG. 33. Now, one of the most beneficial aspects of the Golf Swing Lag Training System comes into play as illustrated in FIG. 34. The large cylindrical foam 48 now snaps back onto the golfer's lead forearm, making a popping sound. So, if the golfer has performed this drill correctly, they get two audible popping sounds. The first, when the slider 109 contacts the bottom hose section 114 in the downswing, and the second, when the large cylindrical foam 48 now snaps back onto the golfer's lead forearm. This signifies that they have released the one-armed slider swing attachment 105 correctly and this is exactly what happens in a normal tour pro golf swing that exhibits lag.

The next drill utilizing the trail arm is illustrated in FIG. 35-37. The golfer starts out as illustrated in FIG. 35. This time the one-armed slider swing attachment 105 is attached by securing the non-slip cap 106 into the basic lag trainer left arm indentation in the base to accept the non-slip cap 84. Then the golfer swings forward to the position illustrated in FIG. 37. Notice that in FIG. 36, the same result attained in FIG. 33 with the lead arm drill is also attained with this drill as the large cylindrical foam 48 now snaps back onto the golfer's trail forearm, making a popping sound. So here again, if the golfer has performed this drill correctly, with the correct release, they get two audible sounds.

A very important extension of both lead and trail arms is illustrated in FIG. 33 and FIG. 36. The average amateur golfer is never able to achieve this extension of both arms because one of the symptoms of 'coming over the top and casting' the golf club is commonly called a "chicken wing." In the "chicken wing" finish position, the golfer's elbows are bent, signifying that they have come over the top of the swing plane, swinging from outside in and casting the club, which totally reduces clubhead speed, distance and directional control.

Another important aspect of these drills with the one-armed slider swing attachment 105 combined with the basic lag trainer 40 is that we have noticed that virtually every amateur golfer moves their head and shoulders forward at the wrong time in the swing, thus preventing the proper release of the golf club through impact. Training with the Golf Swing Lag Training System helps to keep the golfer's head and shoulders to become active at the right time in the drills as illustrated in FIGS. 31-37, which allows the proper release of the golf club through the ball. These drills promote the exact movements in real time that are used in the golf swing.

With reference to FIGS. 45-50, these illustrations show the difference between an amateur and a tour pro's lag checkpoints. Simply put, it is the difference between 'coming over the top and casting' and lagging the club like a tour pro. We developed these three checkpoints because they are crucial if you are to determine if a golfer exhibits lag in their swing. The triangular area marked in each checkpoint is the average variance that the tour pros exhibit in their downswing motion. The first pro lag checkpoint acceptable variation 173 is during the downswing when the golfer's lead arm 152 is positioned parallel to the ground. FIG. 45 shows how an amateur golfer has already lost the ninety degree angle formed by the shaft of the regulation golf club 149 and the golfer's lead arm 152, and the shaft of the regulation golf club 149 of the amateur golfer in FIG. 45 is outside of the first pro lag checkpoint 173 by almost thirty degrees. FIG. 46 shows how the tour pro golfer has retained the angle formed by the shaft of the regulation golf club 149 and the golfer's lead arm 152, and how the shaft of the regulation golf club 149 of the tour pro golfer is inside of the first pro lag checkpoint 173.

Figure 47:
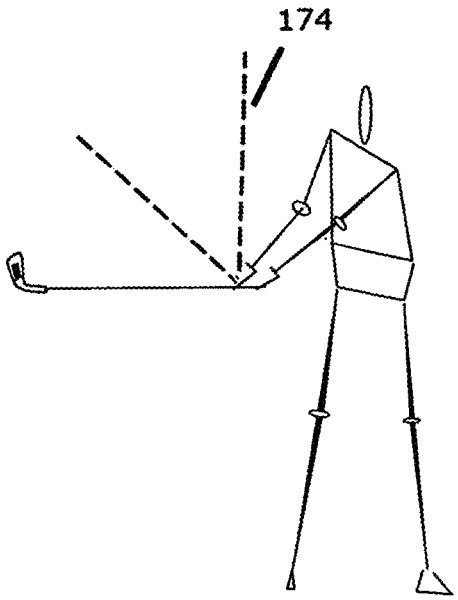
FIG. 47 is a view showing a stick figure of an amateur golfer at lag checkpoint number two.
Figure 48:
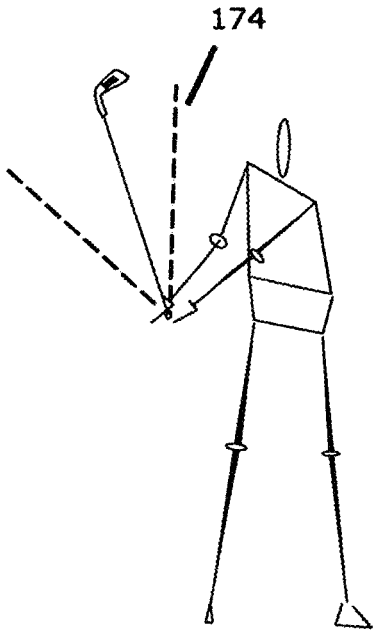
FIG. 48 is a view showing a stick figure of a pro golfer at lag checkpoint number two.

The second pro lag checkpoint acceptable variation 174 occurs when the golfer's lead arm 152 is positioned at about forty-five degrees from perpendicular to the ground as shown in FIGS. 47-48. FIG. 47 shows how the amateur has almost entirely lost the ninety degree angle formed by the shaft of the regulation golf club 149 and the golfer's lead arm 152 and the shaft of the regulation golf club 149 is even more separated from the second pro lag checkpoint 174 than they were in the first pro lag checkpoint 173. FIG. 48 shows how the tour pro golfer has retained the ninety degree angle formed by the shaft of the regulation golf club 149 and the golfer's lead arm 152 and the shaft of the regulation golf club 149 compared to the amateur golfer in FIG. 47.

Figure 49:
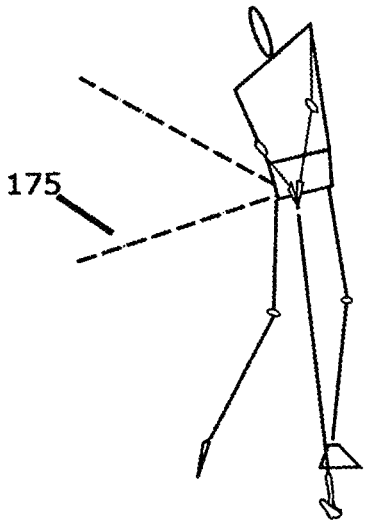
FIG. 49 is a view showing a stick figure of an amateur golfer at lag checkpoint number three.
Figure 50:
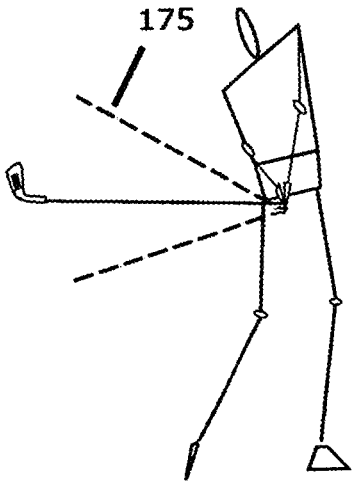
FIG. 50 is a view showing a stick figure of a pro golfer at lag checkpoint number three.

The third pro lag checkpoint acceptable variation 175 occurs when the golfer's lead arm 152 is positioned approximately perpendicular to the ground. FIGS. 49-50 shows how the amateur has not only lost the ninety angle formed by the shaft of the regulation golf club 149 and the golfer's lead arm 152, but has cast the regulation golf club 148 so that it is almost ninety degrees ahead of where the third pro lag checkpoint 175 is. FIG. 51 shows the position of a tour pro at impact 176. The tour pro's shaft of the regulation golf club 149 has a forward lean to it and the tour pro's hands are ahead of the regulation golf club clubhead 151 at impact. We can compare FIG. 51 with FIG. 49, to see the differences between an amateur who is casting the club and the tour pro whose swing exhibits the element of lag. Of particular interest is the fact that the tour pro's shaft of the regulation golf club 149 is leaning forward and the amateur's is leaning backward. In addition, you can see that amateur's hands are behind the regulation golf club clubhead 151 at impact, while the tour pro's hands are ahead of the regulation golf club clubhead 151 at impact. You can also see this leaning forward of the shaft of the regulation golf club 149 in FIG. 27 at impact with the Golf Swing Lag Training System and the three-dimensional plane attachment 127.

FIGS. 53-55 illustrate an alternative method of attaching the basic lag trainer 40 to the various attachments. In FIG. 53, the basic lag trainer 40 is attached to the one-armed slider swing attachment 105 depending downwardly towards the metal bottom stop 116, or just the opposite of the first embodiment shown in FIG. 31.

FIG. 54 shows an anterior view of the golfer with the alternative embodiment setup shown in FIG. 53. FIG. 55 shows how the golfer must insert both hands into the horseshoe rod 74 of the basic lag trainer 40, whereas in the first embodiment of the invention as shown in FIG. 52, only the lead arm 152 is inserted into the horseshoe rod 74, and the trail arm 154 is outside of the horseshoe rod 74. The alternative embodiment setup can be used with any of the two handed drills with any of the multiple attachments.

FIG. 56 shows a pro golfer at address with the lag trainer 40 attached to the structure training club 180. The structure training club grip cap 190 serves the dual purpose of allowing the training club 180 to be easily attached to the lag trainer 40 and securing the structure training club fiberglass tension rod 184 to the top of the structure training club grip 188. The structure training club bent shaft 182 is bent approximately ten to twenty degrees backwards about three-fourths of the way down. The bottom end of the structure training club bent shaft 182 is attached to the structure training club training head 186 by drilling a hole in the head approximately 0.375 inches wide by 2 inches deep and then epoxying it into the training head 186. The training head 186 could be made out of wood or injection molded plastic and is around three inches in diameter. The bottom end of the fiberglass tension rod 184 is also attached to the training head 186 the same way. It is composed of a piece of fiberglass rod approximately 0.20 inches in diameter and about thirty nine inches long.

The purpose of this combination is to provide the correct structure or connectedness of the arms to the upper torso. Once you have the ability to discern the difference between the address position of a tour pro compared to that of an amateur golfer, it becomes apparent that the tour pro has a different feeling at address than the amateur. When the basic lag trainer 40 is attached to the training club 180 as shown in FIG. 56, it encourages the upper arms of the golfer to become more connected to the upper torso. It does this by having the golfer squeeze the structure training club fiberglass tension rod 184 towards the structure training club grip 188 with the last three fingers of the lead hand, while at the same time extending the index finger of the trail hand as far down the shaft as it will go, and squeezing the tension rod 184 towards the grip 188 and shaft 182. By addressing the ball this way with both arms relatively straight, the golfer engages both the pectoralis major and minor muscles on both sides of the body, the deltoid and the forearms extensors on the trail arm 154 and the deltoid and forearm flexors on the lead arm 152.

This enables the golfer to feel what a tour pro feels at address, and lets them employ the one-piece takeaway used by the tour pros. As I've said, I've analyzed over ten thousand PGA tour pro swings for their tempo since the year 2000, and as I was doing that I noticed that sometimes when I couldn't see the clubhead as it started backwards away from the ball in the backswing, I could use the initial movement of the lead shoulder to start counting the individual frames of video that composed the tour player's backswing. The reason that I could use the lead shoulder to start the frame count is that most all tour pros start their backswings with the clubhead moving at the same time as the lead shoulder starts to rotate backward. I found that amateurs do exactly the opposite, they start their backswings by moving the hands and arms separately and pulling their lead shoulder back, instead of making the backswing a total co-ordinated movement of their lead shoulder, arms, and clubhead like the tour pros do. The combination of the lag trainer 40 with the training club 180 allows the amateur golfer to experience this very important feel of a tour pros backswing.

CONCLUSION, RAMIFICATIONS, AND SCOPE

Thus we can see that this new combination of never before combined apparatuses called the Golf Swing Lag Training System provides the golfer with unmistakable positive and negative feedback, as to the correct motions and muscular feelings that must be made in order for their body, including hands, wrists and forearms to be in the proper structure throughout the whole swing. This new, synergistic combination of components consists of a basic lag swing trainer which enables the golfer to attach additional multiple training tools or regulation golf clubs that can be interchangeably used at the same time. The additional combinations of tools that can be attached are unlimited, thereby letting golfers work on more than one of the various aspects of the swing all at the same time, for example, training the golfer in the proper sensations of the backswing technique, the swing plane, and the release of the golf club thru the hitting area. This will allow both inexperienced through scratch golfers to improve their ball striking abilities and achieve the lag of the tour pros.

I claim:

1. A golf training apparatus worn on the wrist of a golfer for use with two or more golf clubs and/or golf training attachments simultaneously comprising:

a. a generally square symmetric frame having a front member, a left side member, a right side member, and a base member;

b. each said side member having a hinge approximately halfway along its length allowing said side members to bend frontwards and rearwards rotating said front and base members towards one another; and c. said base member including a plurality of clamping means for removeably securing more than one golf clubs and/or golf training attachments at a set orientation relative to said frame.

2. The training apparatus of claim 1 wherein said front member is padded.

3. The training apparatus of claim 2 wherein said padding comprises a foam cylinder that surrounds said front member.

4. The training apparatus of claim 1 wherein said clamping means are two screw clamps, one on each side of said base member.

5. The training apparatus of claim 1, further comprising a protective covering over each said side member.

6. The training apparatus of claim 1 further comprising an air resistance training attachment secured to said training apparatus by way of said clamping means.

7. The training apparatus of claim 6, wherein said air resistance training attachment comprises a shaft with grip connected to an air resistance blade and wherein said clamping means clamps the shaft of said air resistance attachment to said base member of said training apparatus.

8. The training apparatus of claim 1 further comprising a slider training attachment that is secured to said training apparatus by way of said clamping means.

9. The training apparatus of claim 8, wherein said slider attachment comprises a shaft having a proximal portion and a distal portion, a grip along the proximal portion of said shaft, a weight slideably mounted along the distal portion of said shaft, and a stopper at the distal end of said shaft, and wherein said clamping means clamps the shaft of said slider attachment to said base member of said training apparatus.

10. The training apparatus of claim 9, further comprising a silencer above the stopper on the distal end of said shaft to muffle the sound of the weight contacting the stopper when the slider attachment is swung.

11. The training apparatus of claim 1 further comprising a three dimensional training attachment secured to said training apparatus by way of said clamping means.

12. The training apparatus of claim 11, wherein said three dimensional training attachment comprises a position rod having one end bent at approximately forty five degrees relative to the remainder of the position rod, and a shaft that extends laterally from the unbent portion of said rod, and wherein said clamping means clamps the shaft of said three dimensional training attachment to said base member of said training apparatus.

13. A golf swing training system comprising:

(a) a wrist apparatus worn on a golfer's forearm and wrist having a generally square symmetric frame comprised of a front member, left and right hinged side members, and a base member; said apparatus worn with the front member lying generally along the radial aspect of the golfer's forearm and the base member lying generally along the ulnar aspect of the golfer's wrist;

(b) a plurality of clamping means for removeably securing more than one golf clubs and/or golf training attachments at a set orientation relative to said frame; and (b) a plurality of golf clubs and/or golf training attachments secured to said base frame member by said clamping means.

14. The system of claim 13, wherein a golf training attachment secured to said wrist apparatus is an air resistance training attachment comprising a shaft with grip connected to an air resistance blade.

15. The system of claim 13, wherein a golf training attachment secured to said wrist apparatus is a slider training attachment comprising a shaft with grip, a weight slideably mounted to the non-grip side of the shaft, and stopper at the end of the non-grip side of the shaft.

16. The system of claim 13, wherein a golf trainer attachment secured to said wrist apparatus is a three dimensional training attachment comprising a position rod having one end bent at approximately forty five degrees relative to the remainder of the position rod, and a shaft that extends laterally from the unbent portion of said rod.

17. A method for golf swing training employing a wrist apparatus worn on a golfer's forearm and wrist comprising the steps of (a) providing a wrist apparatus, said wrist apparatus comprising a generally square symmetric frame with a padded front member, left and right hinged side members, and a base member with a plurality of clamping means;

(b) mounting onto the base member of said wrist apparatus by means of said clamping means a more than one golf clubs and/or golf training attachments;

(c) placing said wrist apparatus with clubs and/or training attachments mounted thereupon on a golfers wrist with padded front frame member lying generally along the radial aspect of the golfer's forearm and base frame member lying generally along the ulnar aspect of the golfer's wrist;

(d) bending the hinged side members such that front and base frame members press against the golfer's radial and ulnar forearm aspects respectively, holding the wrist apparatus in place on the golfer's forearm and wrist;

(e) gripping and swinging, alternatively, the golf clubs/or golf training attachments mounted to said wrist apparatus.

18. The method of claim 17, wherein a golf training attachment mounted to said wrist apparatus is an air resistance training attachment comprising a shaft with grip connected to an air resistance blade.

19. The method of claim 17, wherein a golf training attachment mounted to said wrist apparatus is a slider training attachment comprising a shaft with grip, a weight slideably mounted to the non-grip side of the shaft, and stopper at the end of the non-grip side of the shaft.

20. The method of claim 17, wherein a golf training attachment mounted to said wrist apparatus is a three dimensional training attachment comprising a position rod having one end bent at approximately forty five degrees relative to the remainder of the position rod, and a shaft that extends laterally from the unbent portion of said rod.

21. A method for golf swing training comprising the steps of (a) providing a wrist apparatus, said wrist apparatus comprising a generally square symmetric frame with a padded front member, left and right hinged side members, and a base member with a plurality of clamping means affixed thereto;

(b) mounting onto the base member of said wrist apparatus by means of said clamping means more than one golf clubs and/or golf training attachments;

(c) bending the hinged side members such that front and base frame members are rotated towards one another;

(d) placing both hands inside the frame of said wrist apparatus with clubs and/or training attachments mounted thereupon, such that the front member lies generally along the backside of the trailing hand of the golfer and the base member lies generally along the posterior aspect of the wrist of the leading hand of the golfer; and (e) gripping and swinging, alternatively, the golf clubs/or golf training attachments mounted to said wrist apparatus.

* * * * *